US008185000B2

(12) United States Patent
Aoshima et al.

(10) Patent No.: US 8,185,000 B2
(45) Date of Patent: May 22, 2012

(54) ELECTROSTATIC CHARGING APPARATUS, AND IMAGE FORMING ASSEMBLY AND IMAGE FORMING APPARATUS WHICH EMPLOY THE SAME

(75) Inventors: Taku Aoshima, Kanagawa (JP); Osamu Handa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 386 days.

(21) Appl. No.: 12/264,383

(22) Filed: Nov. 4, 2008

(65) Prior Publication Data

US 2009/0274474 A1 Nov. 5, 2009

(30) Foreign Application Priority Data

Apr. 30, 2008 (JP) ..... P2008-118334

(51) Int. Cl.
*G03G 15/00* (2006.01)
*G03G 15/02* (2006.01)

(52) U.S. Cl. ..... 399/44; 399/50; 399/168; 399/174

(58) Field of Classification Search ..... 399/174
See application file for complete search history.

(56) References Cited

U.S. PATENT DOCUMENTS

| | | | | |
|---|---|---|---|---|
| 4,371,252 | A * | 2/1983 | Uchida et al. | 399/175 |
| 4,380,384 | A * | 4/1983 | Ueno et al. | 399/176 |
| 4,922,299 | A * | 5/1990 | Uchimoto et al. | 399/168 |
| 5,126,913 | A * | 6/1992 | Araya et al. | 361/225 |
| 5,446,615 | A * | 8/1995 | Matsumoto et al. | 361/225 |
| 5,483,323 | A * | 1/1996 | Matsuda et al. | 399/175 |
| 5,842,081 | A * | 11/1998 | Kaname et al. | 399/50 |
| 2002/0102108 | A1* | 8/2002 | Adachi et al. | 399/50 |
| 2004/0018029 | A1* | 1/2004 | Nishihama et al. | 399/174 |
| 2005/0013631 | A1* | 1/2005 | Nishihama et al. | 399/174 |

FOREIGN PATENT DOCUMENTS

| | | |
|---|---|---|
| JP | 8-328360 | 12/1996 |
| JP | 10-186810 | 7/1998 |
| JP | 10-198123 | 7/1998 |
| JP | 11-338221 | 12/1999 |
| JP | 2001-356569 | 12/2001 |
| JP | 2002-62715 | 2/2002 |
| JP | 2002-627156 | 2/2002 |

* cited by examiner

*Primary Examiner* — David Gray
*Assistant Examiner* — David Bolduc
(74) *Attorney, Agent, or Firm* — Morgan, Lewis & Bockius LLP

(57) ABSTRACT

An electrostatic charging apparatus, includes: an endless-shaped electrostatic charging belt having electrical conductivity, the electrostatic charging belt being arranged in a state of having a predetermined contact zone being in contact with a moving to-be-charged body and moving in the same direction as a moving direction of the to-be-charged body; and plural electrode members including at least a first electrode member and a second electrode member, the plural electrode members being provided inside the electrostatic charging belt, and the first and second electrode members being provided on both sides of the contact zone of the electrostatic charging belt in the moving direction thereof so as to press the electrostatic charging belt against the to-be-charged body and forming gaps that permit electric discharge between the to-be-charged body and the electrostatic charging belt, the gaps being adjacent to the respective sides of the contact zone of the electrostatic charging belt.

9 Claims, 18 Drawing Sheets

HERE, Vc (Vc1, Vc2): ELECTROSTATIC CHARGING BIAS
Vc=Vpp (AC COMPONENT)+Vdc (DC COMPONENT)

HERE, Vh: SURFACE POTENTIAL OF TO-BE-CHARGED BODY
Vpp: AC COMPONENT OF ELECTROSTATIC CHARGING BIAS

ELECTROSTATIC CHARGING APPARATUS, AND IMAGE FORMING ASSEMBLY AND IMAGE FORMING APPARATUS WHICH EMPLOY THE SAME

CROSS-REFERENCE TO RELATED APPLICATION

This application is based on and claims priority under 35 USC 119 from Japanese Patent Application No. 2008-118334 filed Apr. 30, 2008.

BACKGROUND

1. Technical Field

The present invention relates to: an electrostatic charging apparatus; and an image forming assembly and an image forming apparatus which employ the same.

2. Related Art

In general, in image forming apparatuses that adopt, for example, an electrophotography method, electrostatic charging apparatuses are widely employed for electrostatically charging a photosensitive body.

As an electrostatic charging apparatus of this kind, a so-called contact type electrostatic charging system is already provided that electrostatically charges a photosensitive body by causing an electrostatic charging roll or an electrostatic charging belt to contact with the photosensitive body serving as a to-be-charged body.

SUMMARY

According to an aspect of the invention, there is provided an electrostatic charging apparatus, including:

an endless-shaped electrostatic charging belt having electrical conductivity, the electrostatic charging belt being arranged in a state of having a predetermined contact zone being in contact with a moving to-be-charged body and moving in the same direction as a moving direction of the to-be-charged body; and plural electrode members including at least a first electrode member and a second electrode member, the plural electrode members being provided inside the electrostatic charging belt, and the first and second electrode members being provided on both sides of the contact zone of the electrostatic charging belt in the moving direction thereof so as to press the electrostatic charging belt against the to-be-charged body and forming gaps that permit electric discharge between the to-be-charged body and the electrostatic charging belt, the gaps being adjacent to the respective sides of the contact zone of the electrostatic charging belt.

BRIEF DESCRIPTION OF THE DRAWINGS

Exemplary embodiments of the present invention will be described in detail based on the following figures, wherein.

DETAILED DESCRIPTION

Outline of Exemplary Embodiments

Figure 1A:
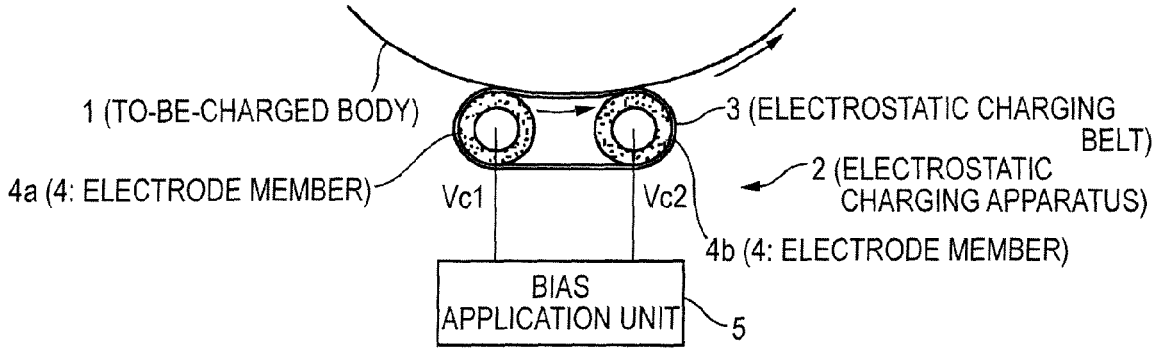
FIG. 1A is an explanation diagram showing an outline of an exemplary embodiment of an electrostatic charging apparatus in which the present invention is applied and FIG. 1B is an explanation diagram showing the setting of an AC component Vpp of an electrostatic charging bias of an electrostatic charging apparatus.

FIG. 1A shows the outline of exemplary embodiments of an electrostatic charging apparatus to which the present invention is applied.

In this figure, an electrostatic charging apparatus 2 is a functional component for electrostatically charging a photosensitive body serving as a to-be-charged body 1, and constitutes, for example, a member component of an image forming apparatus of electrophotography method or alternatively a member component of an image forming assembly that is attachable to and detachable from an image forming apparatus body.

In the present exemplary embodiment, the electrostatic charging apparatus 2 includes: an endless-shaped electrostatic charging belt 3 that has electrical conductivity and that is arranged in a state of having a predetermined contact zone relative to a moving to-be-charged body 1 and moves in the same direction as a moving direction of the to-be-charged body 1; electrode members 4 (4*a*, 4*b* in this example) of paired configuration that are provided inside the electrostatic charging belt 3 on both sides of the contact zone of the electrostatic charging belt 3 relative to the to-be-charged body 1 so as to press the electrostatic charging belt 3 against the to-be-charged body 1 and that form a gap that permits electric discharge between the to-be-charged body 1 and the electrostatic charging belt 3 in an adjacent location to the contact zone of the electrostatic charging belt 3; and a bias application unit 5 that applies mutually different electrostatic charging biases Vc (Vc1, Vc2) on the electrode members 4 (4*a*, 4*b*), respectively, such that an AC component Vpp1 of the electrostatic charging bias Vc1 applied on the electrode member 4*a* located in an upstream of the moving direction of the to-be-charged body 1 should at least be smaller than an AC component Vpp2 of the electrostatic charging bias Vc2 applied on the electrode member 4*b* located in a downstream of the moving direction of the to-be-charged body 1.

In such technical means, the to-be-charged body 1 is a photosensitive body when applied to an image forming apparatus of electrophotography method. However, the present invention is not limited to this photosensitive body, and includes a wide variety of to-be-charged members such as a dielectric material of an electrostatic recording apparatus.

Further, the electrostatic charging belt 3 may rotate by following the to-be-charged body 1, or alternatively may be driven by any other measures.

Further, the electrode members 4 (4*a*, 4*b*) of paired configuration are, typically, rotatable roll-shaped members about which an electrostatic charging belt 3 is entrained. However, their revolution is not indispensable, and hence they may be fixed members. However, the electrode members 4 need permit movement of the electrostatic charging belt 3 and need have a shape (e.g., a curved surface shape) that forms a gap permitting electric discharge in an adjacent location to the contact zone of the electrostatic charging belt 3.

Furthermore, the electrode members 4 (4*a*, 4*b*) of paired configuration need press the electrostatic charging belt 3 against the to-be-charged body 1. This requirement may be satisfied by the use of biasing members such as springs. The required magnitude of this pressing is such that the gap serving as a discharge region between the electrostatic charging belt 3 and the to-be-charged body 1 is formed stably.

Further, inside the electrostatic charging belt 3, belt entraining members and auxiliary members for driving may be provided in addition to the electrode members 4 (4*a*, 4*b*).

Further, the electrostatic charging biases Vc applied by the bias application unit 5 include a wide variety of voltages in which the AC component Vpp1 of the electrostatic charging bias Vc1 applied on the electrode member (upstream electrode member) 4*a* located in the upstream of the moving direction of the to-be-charged body 1 is smaller than that of the bias applied on the electrode member (downstream electrode member) 4*b* located in the downstream of the moving direction of the to-be-charged body 1. This includes a mode that the electrostatic charging bias Vc1 onto the upstream electrode member 4*a* has only a DC component Vdc and hence its AC component Vpp1 is zero.

When such an electrostatic charging biases Vc are set up, in the pre-nip (the gap located in the upstream of the moving direction of the to-be-charged body 1 in an adjacent location to the contact zone between the to-be-charged body 1 and the electrostatic charging belt 3), the AC component Vpp1 of the electrostatic charging bias Vc1 is small. Thus, apart from the presence of a variation in the electrostatic charging potential, the average potential increases. On the other hand, in the post-nip (the gap located in the downstream of the moving direction of the to-be-charged body 1 in an adjacent location to the contact zone between the to-be-charged body 1 and the electrostatic charging belt 3), the AC component Vpp2 of the electrostatic charging bias Vc2 is large. Thus, the electrostatic charging potential of the to-be-charged body 1 has a desired value and is uniform.

Further, in the pre-nip, the AC component Vpp1 of the electrostatic charging bias Vc1 is smaller than the AC component Vpp2 of the electrostatic charging bias Vc2 in the post-nip. This reduces degradation (adhesion of discharge product and wear) caused by electric discharge in the to-be-charged body 1 in the pre-nip in comparison with that in the post-nip.

Figure 1B:
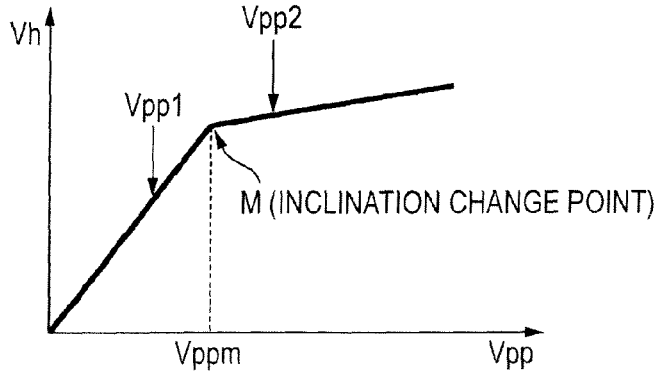

Next, in the present exemplary embodiment, a preferable mode of the electrostatic charging bias Vc1 applied on the upstream electrode member 4*a* is that the bias application unit 5 applies on the upstream electrode member 4*a* an electrostatic charging bias Vc1 whose AC component Vpp1 is equal to or below an inclination change point M of the surface potential of the to-be-charged body 1 for the AC component Vpp as shown in FIG. 1B.

Further, a preferable mode of the electrostatic charging bias Vc2 applied on the downstream electrode member 4*b* is that the bias application unit 5 applies on the downstream electrode member 4*b* an electrostatic charging bias Vc2 whose AC component Vpp2 exceeds an inclination change point M of the surface potential of the to-be-charged body 1 for the AC component Vpp as shown in FIG. 1B and falls within a usage range where uniform electric discharge can be performed toward the surface of the to-be-charged body 1.

Further, the electrostatic charging biases may be fixed. Alternatively, the electrostatic charging biases may be changed in accordance with the operating environment.

In this mode, the bias application unit 5 may have an operating environment determination section capable of determining the operating environment and may change the electrostatic charging biases Vc (Vc1, Vc2) onto the individual electrode members 4 (4*a*, 4*b*) on the basis of a determination result from the operating environment determination section. The operating environment described here includes the environment of the surroundings such as the temperature and the humidity as well as the environment of time elapse that depends on the usage history.

The present invention is described below in further detail with reference to the exemplary embodiments shown in the accompanying drawings.

Exemplary Embodiment 1

Image Forming Apparatus

Figure 2:
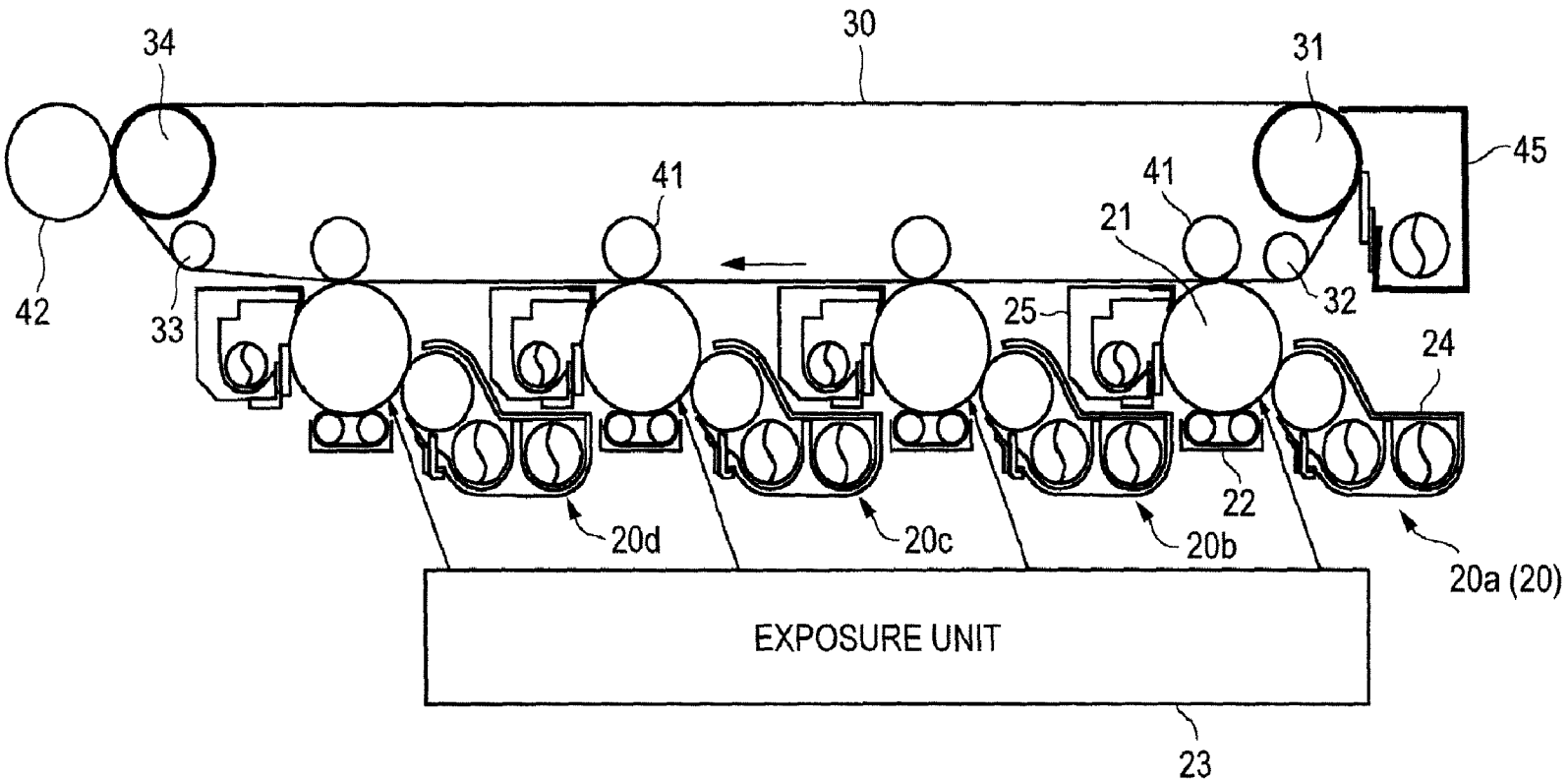
FIG. 2 is an explanation diagram showing an overall configuration of an image forming apparatus according to Exemplary Embodiment 1.

FIG. 2 shows the overall configuration of an image forming apparatus according to Exemplary Embodiment 1.

In this figure, in the image forming apparatus, image forming sections 20 (20*a* to 20*d*) of four colors (yellow, magenta, cyan, and black in this example) that employ an electrophotography method or the like are arranged, for example, in a horizontal direction. Then, an intermediate transfer belt 30 is arranged in a manner permitting circulating movement in a location opposite to the image forming sections 20.

The intermediate transfer belt 30 is entrained about plural belt entraining rolls 31 to 34. Then, the image forming sections 20 (20*a* to 20*d*) are provided in correspondence to a straight line section of the intermediate transfer belt 30 between the belt entraining rolls 32 and 33. Further, a primary transfer unit (e.g., a primary transfer roller) 41 is arranged on the rear face of the intermediate transfer belt 30 in correspondence to each of the image forming sections 20 (20*a* to 20*d*). A secondary transfer unit (e.g., a secondary transfer roller) 42 is provided in a part of the intermediate transfer belt 30 opposite to the belt entraining roll 34. Furthermore, a belt cleaning unit 45 is provided in a part of the intermediate transfer belt 30 opposite to the belt entraining roll 31.

Then, in the present exemplary embodiment, each color toner image formed by each image forming section 20 is sequentially primary-transferred onto the intermediate transfer belt 30 by the primary transfer unit 41. Then, the color toner image multi-transferred onto the intermediate transfer belt 30 is secondary-transferred onto a recording material (not shown) by a secondary transfer unit 42. The toner image having been secondary-transferred is guided to the fixing unit (not shown) together with the recording material. Then, the toner image is fixed onto the recording material, for example, by heat pressing.

—Image Forming Section—

Figure 3:
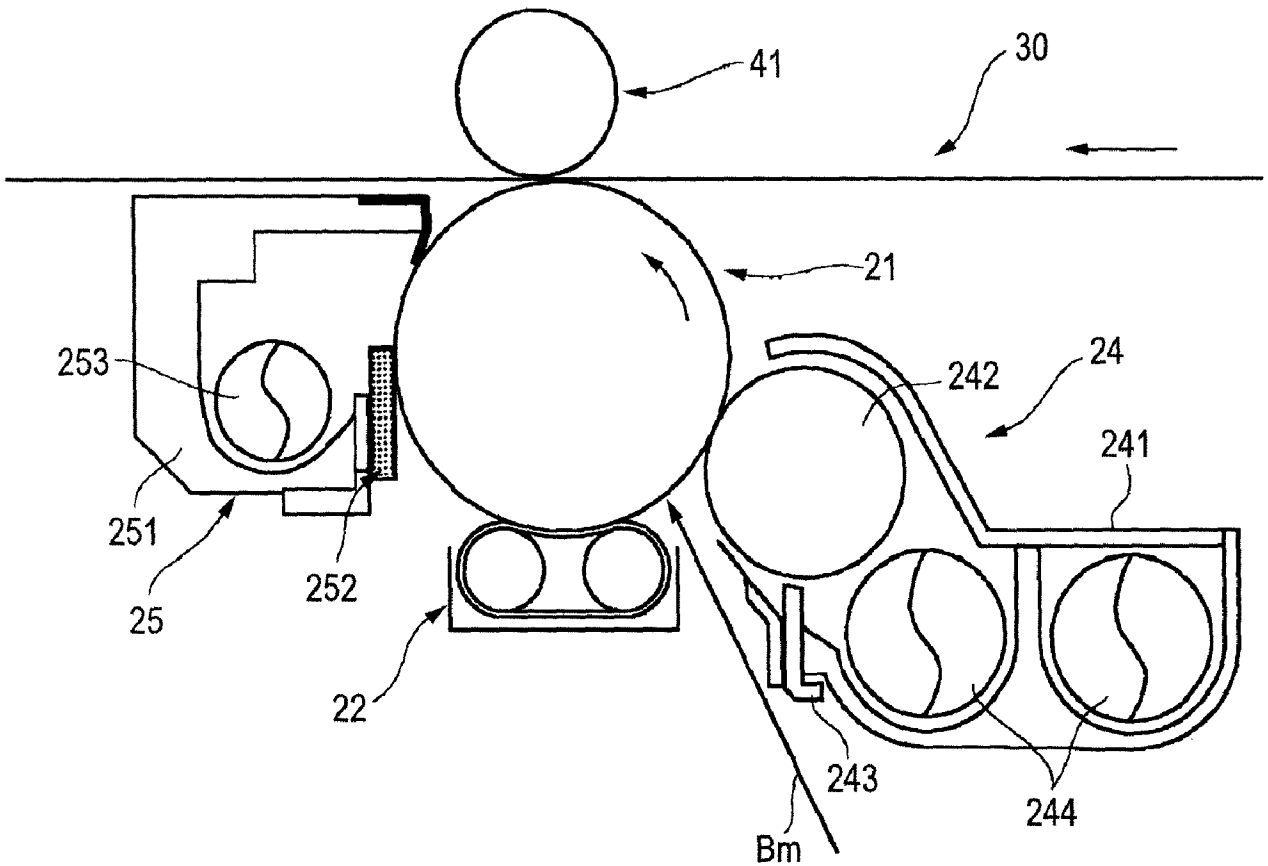
FIG. 3 is an explanation diagram showing details of each color image forming section according to Exemplary Embodiment 1.

In the present exemplary embodiment, as shown in FIGS. 2 and 3, each of the image forming sections 20 (20*a* to 20*d*) includes: a drum-shaped photosensitive body 21 that rotates in a predetermined direction; an electrostatic charging apparatus 22 that is provided in a periphery of the photosensitive body 21 and electrostatically charges the photosensitive body 21; an exposure unit 23 such as a laser scanner that writes an electrostatic latent image of each color component by light onto the photosensitive body 21 charged by the electrostatic charging apparatus 22; a developing unit 24 that makes visible each electrostatic latent image on the photosensitive body 21 with a corresponding color toner; and a cleaning unit 25 that is provided in the downstream of the primary transfer region of the photosensitive body 21 opposite to the primary transfer unit 41 and cleans residual toner on the photosensitive body 21.

Here, in the present exemplary embodiment, the exposure unit 23 is shared by the four image forming sections 20. However, the present invention is not restricted to this configuration. That is, for example, a writing unit such as an LED array may be arranged in correspondence to each of the photosensitive bodies 21. Further, in FIG. 3, symbol Bm indicates a beam from the exposure unit 23.

In the present exemplary embodiment, the photosensitive body 21 may be selected appropriately including an organic photosensitive body. However, from the perspective of wear prevention as much as possible, a photosensitive body is preferred in which a material of high hardness is used in the surface layer so that excellent wear resistance is achieved.

An example of the photosensitive body 21 of this kind is obtained when: an under coating layer for leakage prevention is stacked on a drum base composed of aluminum or the like; then, a charge generating layer having a film thickness of, for example, 1 μm or smaller is stacked on the under coating layer; and then, a charge transport layer having a film thickness of, for example, 15 to 40 μm is stacked on the charge generating layer.

Here, a wear-resistant surface layer may be stacked on the charge transport layer when necessary. In this case, the surface layer may be, for example, an a-SiN:H film or alternatively an a-C:H film or an a-C:H:F film in which Si is not contained. Then, wear resistance is achieved in which the wear loss per 1000 revolutions is 20 nm or smaller.

Further, the developing unit 24 may employ, for example, a two-component development method. In this case, as shown in FIG. 3, two-component developing agent composed of toner and carrier is accommodated in a development container 241. Then, a developing roll 242 for developing agent conveyance is arranged in a location facing an opening of the development container 241 opposite to the photosensitive body 21. Further, a layer thickness restricting member 243 for restricting the layer thickness of the developing agent is arranged in a periphery of the developing roll 242. Further, an agitation conveyance member 244 for performing agitation conveyance of the developing agent in a circulated manner is provided on the rear face side of the developing roll 242.

Further, the cleaning unit 25 may employ, for example, a blade cleaning method. In this case, as shown in FIG. 3, a blade 252 is provided at the opening edge of a cleaning container 251 opposite to the direction of rotation of the photosensitive body 21. Then, a collection conveyance member 253 is provided inside the cleaning container 251. Thus, the blade 252 scrapes residual toner on the photosensitive body 21. Then, the collection conveyance member 253 conveys the collected toner to a waste toner collection container (not shown).

Further, in the present exemplary embodiment, the photosensitive body 21 and its peripheral components are integrated into the form of a process cartridge. Then, this cartridge is detachably attached to the image forming apparatus body. Here, the peripheral components integrated with the photosensitive body 21 into a process cartridge may be, for example, in a mode that the electrostatic charging apparatus 22 and the cleaning unit 25 are incorporated. Alternatively, a mode may be employed in which the electrostatic charging apparatus 22 is solely incorporated. Further, a mode may be employed in which the electrostatic charging apparatus 22, the cleaning unit 25, and the developing unit 24 are incorporated.

—Electrostatic Charging Apparatus—

Next, the electrostatic charging apparatus 22 employed in the present exemplary embodiment is described below in further detail.

Figure 4:
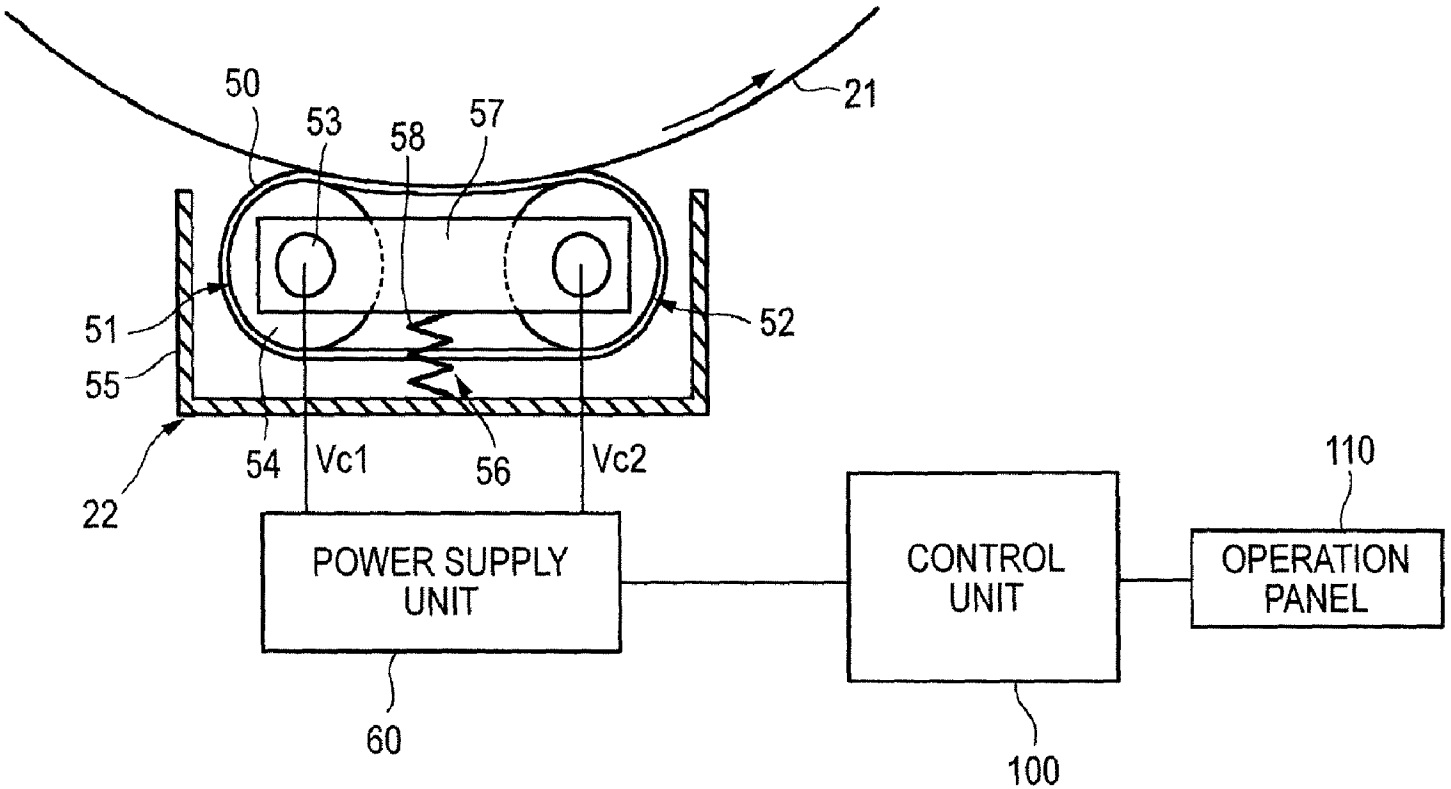
FIG. 4 is an explanation diagram showing details of an electrostatic charging apparatus according to Exemplary Embodiment 1.

FIG. 4 schematically shows the configuration of the electrostatic charging apparatus 22 employed in the present exemplary embodiment.

In this figure, the electrostatic charging apparatus 22 includes: an endless-shaped electrostatic charging belt 50 having electrical conductivity; a pair of bias application rolls 51 and 52 about which the electrostatic charging belt 50 is entrained and onto which electrostatic charging biases are applied; an electrostatic charging container 55 for accommodating the electrostatic charging belt 50 and the bias application rolls 51 and 52; and a pressing mechanism 56 for pressing the bias application rolls 51 and 52 toward the photosensitive body 21 side.

Here, the employed electrostatic charging belt 50 is a thin film of 20 to 100 μm formed by dispersing an electric conduction agent into PVdF, polyamide, polyimide, polyetherimide, elastomer PVdF, polyester, polycarbonate, polyolefin, PEN, PEK, PES, PPS, PFA, ETFE, CTFE, or the like so as to adjust the surface electrical resistance into $10^6$ to $10^8\Omega/\square$ or the like.

Further, each of the bias application rolls 51 and 52 is an electrically conductive resin material 54 through which a shaft core member 53 composed of an electrically conductive metal penetrates. Here, the electrically conductive resin material 54 may be composed of various kinds of materials including an electrically conductive foaming polyester.

Further, in the pressing mechanism 56, electrically conductive resin bearings (not shown) are assembled into a bearing support member 57, then the electrically conductive resin bearings support the shaft core members 53 of the bias application rolls 51 and 52 in a rotatable manner, and then a press spring 58 biases the bearing support member 57 so as to press the bias application rolls 51 and 52 toward the photosensitive body 21 side.

The value of pressing force of the press spring 58 is selected as follows. That is, the electrostatic charging belt 50 and the photosensitive body 21 have a contact zone m between the bias application rolls 51 and 52. Then, on both sides of the contact zone m, a pre-nip gap g1 and a post-nip gap g2 are formed that permit electric discharge between the electrostatic charging belt 50 and the photosensitive body 21. At this time, as described later, as seen from the magnitude relation of the electrostatic charging biases applied on the bias application rolls 51 and 52, fluctuation in the post-nip gap g2 located in the downstream of the moving direction of the photosensitive body 21 across the contact zone m causes a possibility of instability in the electric discharge. Accordingly, a value need be selected at least in a range that the post-nip gap g2 does not fluctuate.

In this example, the pressing mechanism 56 imparts approximately identical pressing forces to the pair of bias application rolls 51 and 52. Thus, apart from the weights of the bias application rolls 51 and 52, one end of the bias application rolls 51 and 52 is pressed with a force of 250 to 350 gf (2.45 to 3.43 N) or the like.

—Electrostatic Charging Bias—

Further, a power supply unit 60 is connected to the individual bias application rolls 51 and 52 of the electrostatic charging apparatus 22. Then, the power supply unit 60 supports mutually different electrostatic charging biases Vc1 and Vc2.

Figure 5:
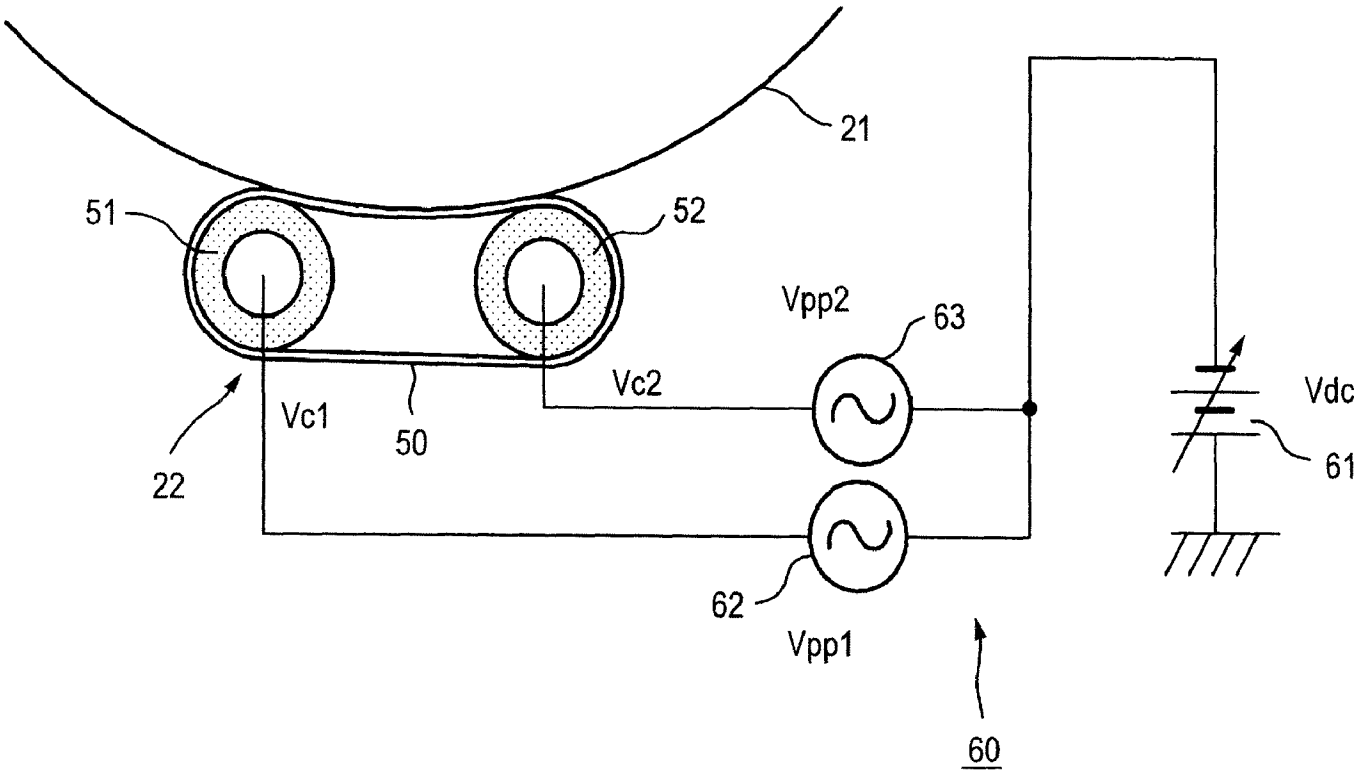
FIG. 5 is an explanation diagram showing an exemplary example of a power supply unit of FIG. 4.

FIG. 5 shows an example of the power supply unit 60.

In this figure, the power supply unit 60 includes: a DC power supply 61 for supplying a DC component Vdc of the electrostatic charging biases Vc (Vc1, Vc2); an AC power supply 62 that is connected in series to the DC power supply 61 and that supplies an AC component Vpp1 (peak-to-peak voltage) of the electrostatic charging bias Vc (Vc1) to the bias application roll 51 located in the upstream of the moving direction of the photosensitive body 21; and an AC power supply 63 that is connected in series to the DC power supply 61 and that supplies an AC component Vpp2 (peak-to-peak voltage) of the electrostatic charging bias Vc (Vc2) to the bias application roll 52 located in the downstream of the moving direction of the photosensitive body 21.

In the setting of the present exemplary embodiment, the AC component Vpp1 of the electrostatic charging bias Vc1 applied on the one bias application roll 51 is smaller than the AC component Vpp2 of the electrostatic charging bias Vc2 applied on the other bias application roll 52.

Figure 6A:
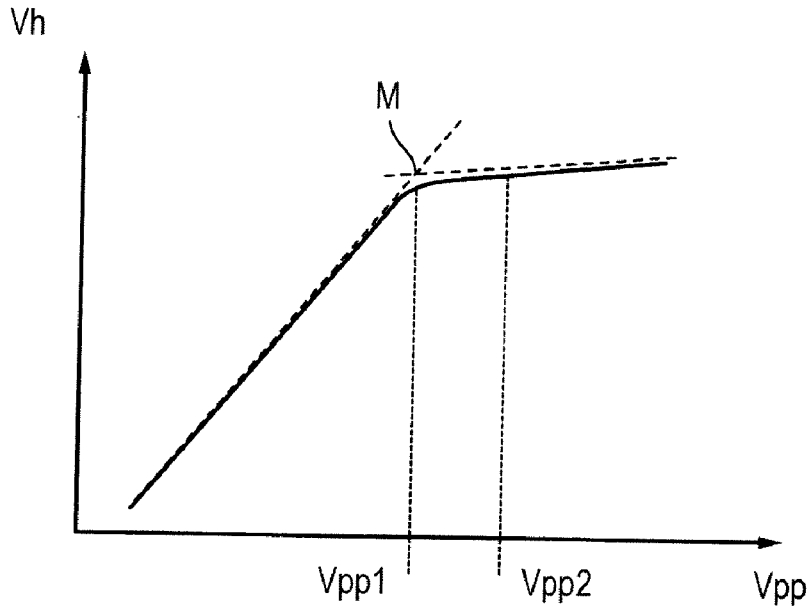
FIG. 6A is an explanation diagram showing a method of setting an AC component of an electrostatic charging bias and FIG. 6B is an explanation diagram showing a method of setting a DC component of an electrostatic charging bias.

More specifically, FIG. 6A shows the relation between the AC component Vpp of the electrostatic charging bias Vc applied on one electrostatic charging roll and the surface potential Vh of the photosensitive body 21 charged with this bias.

As seen from this figure, when the AC component Vpp of the electrostatic charging bias Vc increases, the surface potential Vh of the photosensitive body 21 increases almost linearly and then becomes saturated. That is, the tendency of increase in the surface potential Vh of the photosensitive body 21 becomes weaker beyond an inclination change point M corresponding to the saturation point.

At that time, when the AC component Vpp of the electrostatic charging bias Vc is equal to or below the inclination change point M, non-uniformity in the electrostatic charging occurs easily in the surface of the photosensitive body 21. That is, when the AC component Vpp of the electrostatic charging bias Vc is at a level slightly exceeding the inclination change point M, non-uniform electric discharge is performed toward the surface of the photosensitive body 21 so that white dots and color (black) dots are easily caused by the non-uniform electric discharge. However, when the AC component Vpp of the electrostatic charging bias Vc exceeds a predetermined value, uniform electric discharge is performed toward the surface of the photosensitive body 21. This reduces the above-mentioned difficulty (generation of white dots and color (black) dots) caused by the non-uniform electric discharge. Nevertheless, discharge product is generated, and then the discharge product is easily deposited on the photosensitive body 21 surface. In this case, when the AC component Vpp of the electrostatic charging bias Vc is to be selected from the perspective of suppression of the deposition of discharge product as much as possible, a value should be selected that is the necessary minimum at the lower limit level within a usage range where uniform electric discharge is achieved toward the surface of the photosensitive body 21.

In conclusion, the AC component Vpp1 of the electrostatic charging bias Vc1 applied on the bias application roll 51 is selected into a value equal to or below the inclination change point M, while the AC component Vpp2 of the electrostatic charging bias Vc2 applied on the bias application roll 52 is selected into a value that exceeds the inclination change point M and, preferably, into a value at the minimum level where uniform electric discharge is achieved.

Figure 6B:
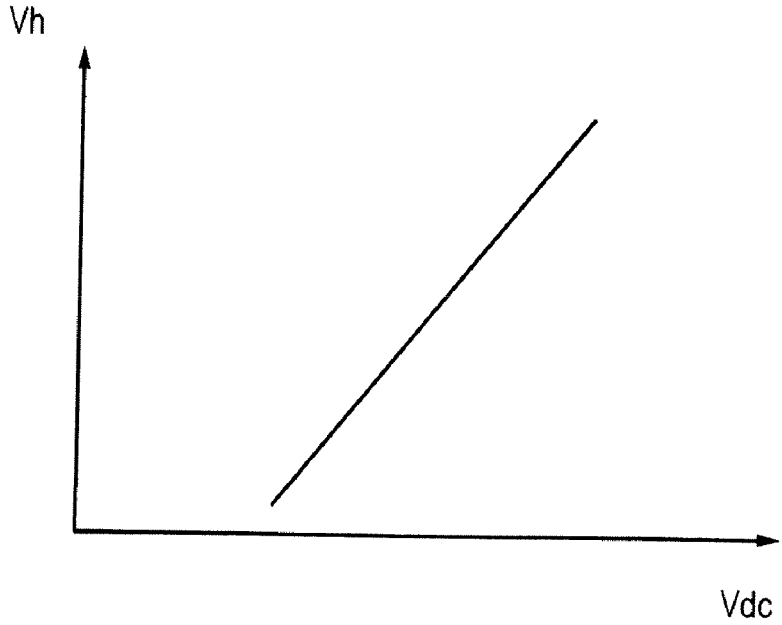

On the other hand, FIG. 6B shows the relation between the DC component Vdc of the electrostatic charging bias Vc applied on one electrostatic charging roll and the surface potential Vh of the photosensitive body 21 charged with this bias.

As seen from this figure, the surface potential Vh of the photosensitive body 21 is approximately linear to the DC component Vdc of the electrostatic charging bias Vc. Thus, a value corresponding to the electrostatic charging target potential is selected for the DC component Vdc of the electrostatic charging bias Vc.

As a result, the electrostatic charging biases Vc1 and Vc2 are selected as follows.

$$Vc1=Vdc+Vpp1\ (Vpp1<Vpp2)$$

$$Vc2=Vdc+Vpp2$$

Further, the control unit 100 shown in FIG. 4 determines the application timing for the electrostatic charging biases Vc (Vc1, Vc2) of the power supply unit 60; and their DC component Vdc and AC components Vpp (Vpp1, Vpp2).

Here, the DC component Vdc and the AC components Vpp (Vpp1, Vpp2) of the electrostatic charging biases Vc are set by initial setting in advance, for example, by input operation through the operation panel 110.

—Operation of Electrostatic Charging Apparatus—

Next, an electrostatic charging operation process by the electrostatic charging apparatus 22 according to the present exemplary embodiment is described below.

Figure 7A:
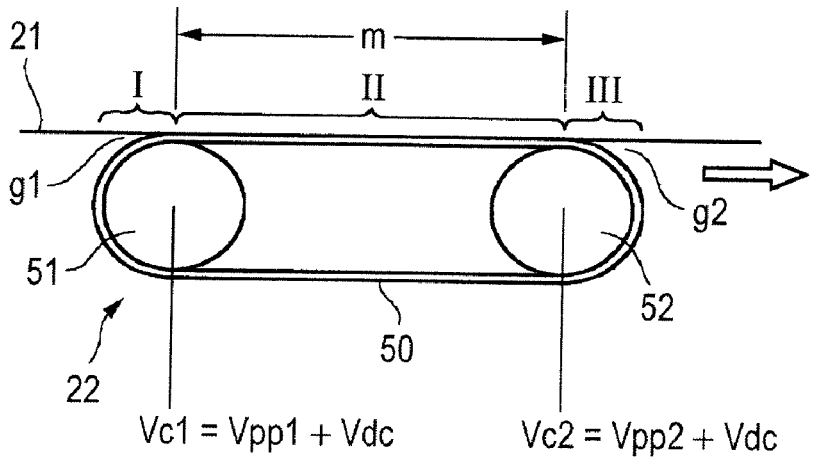
FIG. 7A is an explanation diagram schematically showing an electrostatic charging operation process performed by an electrostatic charging apparatus according to Exemplary Embodiment 1 and FIG. 7B is an explanation diagram schematically showing an electrostatic charging operating state achieved by this electrostatic charging apparatus.

As shown in FIGS. 2 and 7A, in each of the image forming sections 20 (20*a* to 20*d*), the electrostatic charging apparatus 22 electrostatically charges the photosensitive body 21.

At that time, the electrostatic charging bias Vc1=Vdc+Vpp1 is applied on the bias application roll 51 located in the upstream of the moving direction of the photosensitive body 21, so that electric discharge is performed in the pre-nip gap g1 (region I in FIG. 7A).

Figure 7B:
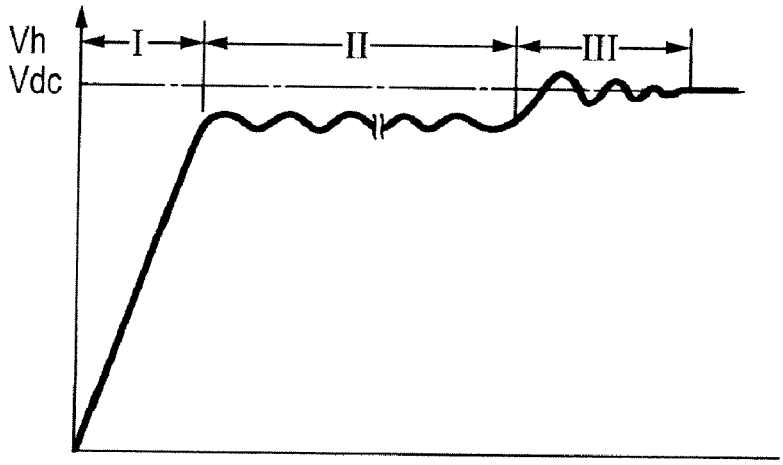

At that time, Vpp1 is set equal to or below the inclination change point M shown in FIG. 6A. Thus, sufficient electrostatic charging is not performed in region I. However, since the pre-nip gap g1 becomes gradually narrow, the average electrostatic charging potential on the surface of the photosensitive body 21 increases as shown in FIG. 7B. As a result, a surface potential is generated in accordance with the frequency of the electrostatic charging bias Vc.

After that, electric discharge does not occur in the contact zone m between the electrostatic charging belt 50 and the photosensitive body 21 (region II in FIG. 7A). Thus, as shown in FIG. 7B, the amplitude of the surface potential of the photosensitive body 21 remains intact and enters into the post-nip gap g2 (region III in FIGS. 7A and 7B).

In the post-nip gap g2, the electrostatic charging bias Vc2=Vdc+Vpp2 is applied on the bias application roll 52 located in the downstream of the moving direction of the photosensitive body 21, so that electric discharge is performed.

At that time, the post-nip gap g2 becomes gradually wide. Thus, as shown in FIG. 7B, the large amplitude of the surface potential having been present near the contact zone m of the post-nip gap g2 is averaged in accordance with the widening of the gap. Then, in the termination part of the post-nip gap g2 (region III), the surface potential of the photosensitive body 21 becomes uniform.

Figure 8A:
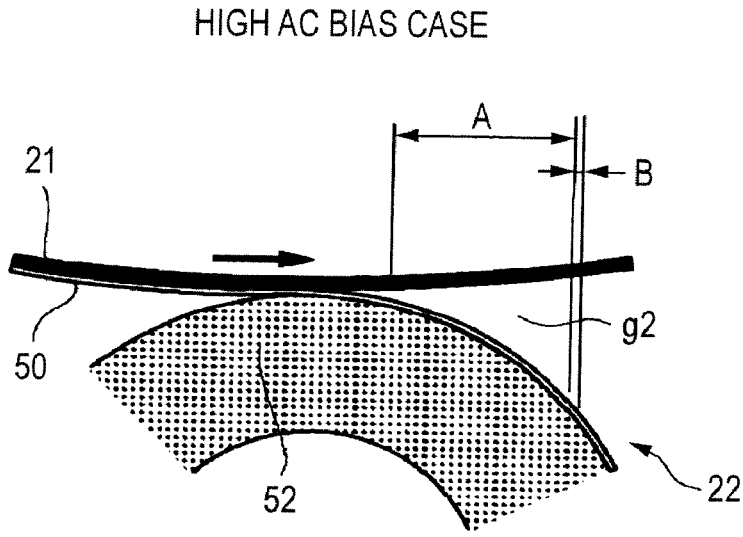
FIG. 8A is an explanation diagram showing operation performed in a post-nip of an electrostatic charging apparatus according to Exemplary Embodiment 1 (in a case of a high AC bias) and FIG. 8B is an explanation diagram showing operation performed in a post-nip of an electrostatic charging apparatus according to a comparison example (in a case of a low AC bias)

This is expectedly accounted for as follows. The AC component Vpp2 of the electrostatic charging bias Vc2 exceeds the inclination change point M shown in FIG. 6A and is at a sufficiently high level for uniform electric discharge (in the case of a high AC bias), for example, as shown in FIG. 8A. Thus, the effective discharge region A extends even to the vicinity of the termination part of the post-nip gap g2. This suppresses the influence of gap fluctuation and resistance non-uniformity in the termination part of the post-nip gap g2, and hence remarkably reduces the unstable discharge regions B.

Figure 8B:
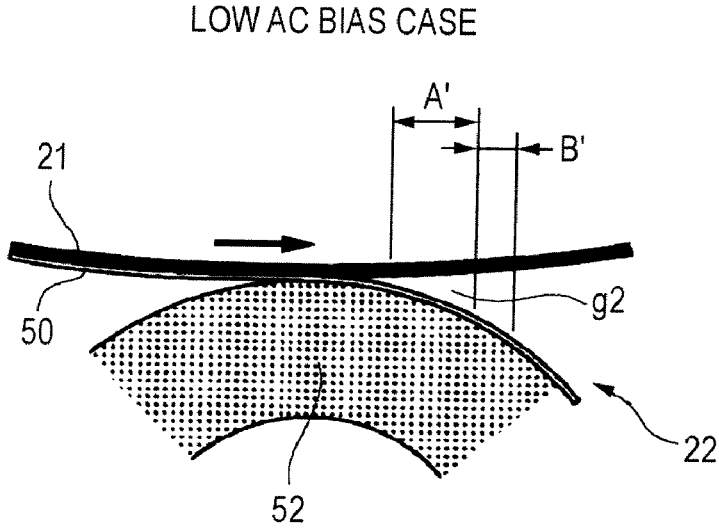

As for this point, for example, as shown in FIG. 8B, in a conceptual comparison example in which the AC component Vpp2 of the electrostatic charging bias Vc2 is equal to or below the inclination change point M shown in FIG. 6A or alternatively in a non-uniform discharge region immediately above the inclination change point M, the effective discharge region A' of the post-nip gap g2 becomes narrow so that the vicinity of the termination part of the post-nip gap g2 belongs to the unstable discharge region B'. Thus, gap fluctuation and resistance non-uniformity in the termination part of the post-nip gap g2 have a large influence and hence cause a possibility of occurrence of white dots and color (black) dots caused by non-uniformity or defects in the electrostatic charging resulting from the unstable electric discharge.

Here, the unstable discharge region in the pre-nip gap g1 is located in the upstream of the start part of the effective discharge region. Thus, its influence does not appear.

As described above, in the present exemplary embodiment, in the pre-nip gap g1 of the electrostatic charging belt 50, it is sufficient that the function of increasing the average surface potential of the photosensitive body 21 is realized. On the other hand, in the post-nip region g2 of the electrostatic charging belt 50, it is sufficient that the function of averaging and equalizing the surface potential of the photosensitive body 21 is realized.

That is, the electrostatic charging functions of the pre-nip gap g1 and the post-nip gap g2 of the electrostatic charging belt 50 are separated. Then, in the pre-nip gap g1, the minimum Vpp1 within a range where the desired electrostatic charging voltage is obtained is selected. In contrast, in the post-nip gap g2, the minimum Vpp2 within a range where image defects (white dots and color (black) dots) do not occur is selected.

In particular, in the pre-nip gap g1, the AC component Vpp1 of the electrostatic charging bias Vc1 is set small. This reduces degradation (the amount of deposit of discharge product and the amount wear loss) in the photosensitive body 21 surface caused by electric discharge in comparison with a mode in which the AC component Vpp2 similar to that for the post-nip gap g2 is applied on the pre-nip gap g1.

Exemplary Embodiment 2

Figure 9:
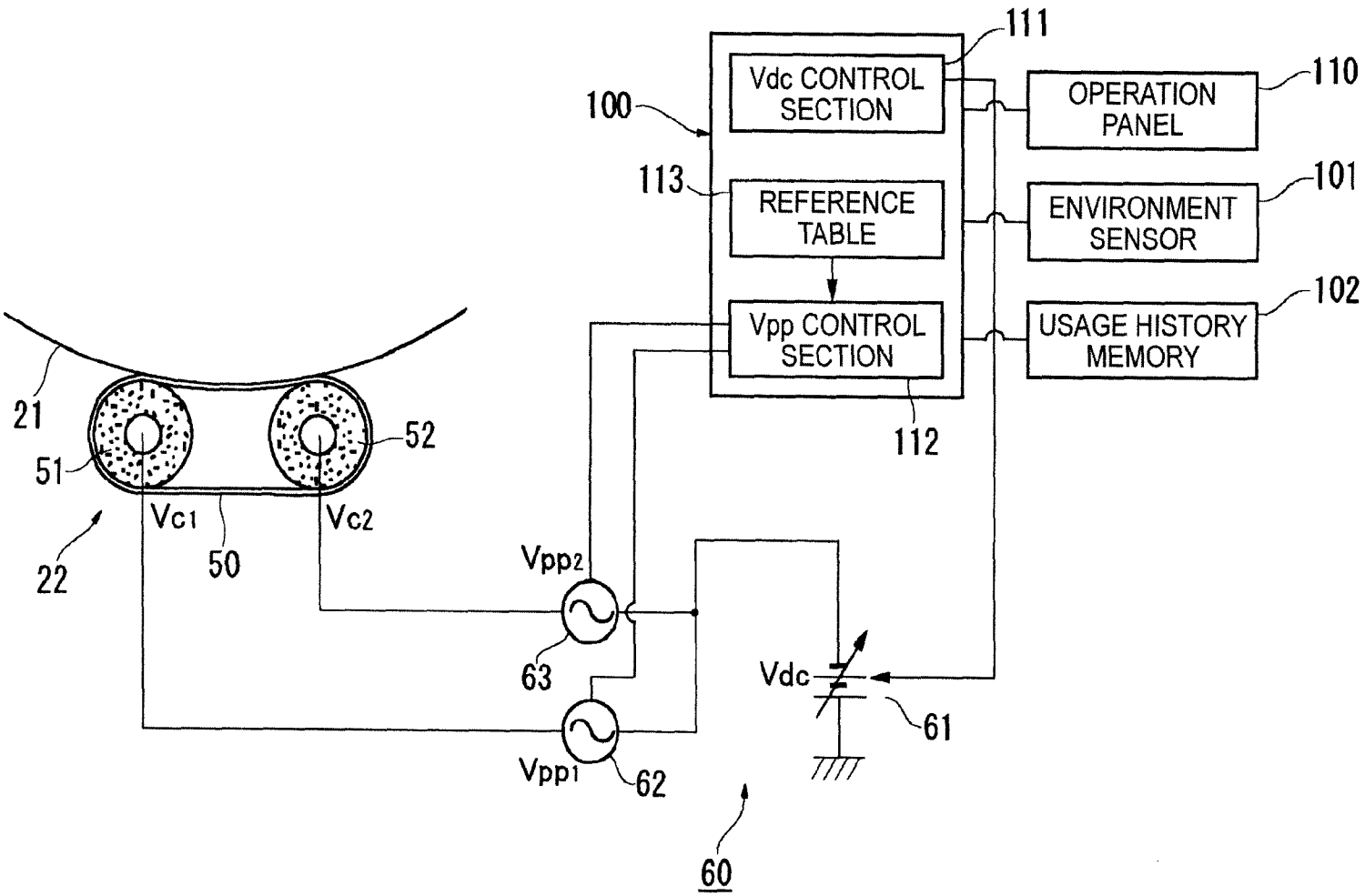
FIG. 9 is an explanation diagram showing an exemplary example of an electrostatic charging bias setting control system of an electrostatic charging apparatus according to Exemplary Embodiment 2.

FIG. 9 shows an electrostatic charging apparatus 22 employed in an image forming apparatus according to Exemplary Embodiment 2.

In the present exemplary embodiment, similarly to Exemplary Embodiment 1, in the electrostatic charging apparatus 22, an electrostatic charging bias Vc1=Vdc+Vpp1 is applied on the bias application roll 51 located in the upstream of the moving direction of the photosensitive body 21. Further, an electrostatic charging bias Vc2=Vdc+Vpp2 is applied on the bias application roll 52 located in the downstream of the moving direction of the photosensitive body 21.

Then, a value for Vpp1 is selected such as to correspond to the inclination change point M (see FIG. 6A) in the surface potential change curve of the photosensitive body 21 to the AC component of the electrostatic charging bias Vc1. On the other hand, a value for Vpp2 is selected such as to exceed the inclination change point M of the surface potential change curve of the photosensitive body 21 for the AC component of the electrostatic charging bias Vc2 and correspond to the lower limit (the uniform electrostatic charging region lower limit point) of the usage range where uniform electric discharge is achieved.

However, the electrostatic charging apparatus 22 according to the present exemplary embodiment is different from that of Exemplary Embodiment 1 in the point that the electrostatic charging biases Vc (Vc1, Vc2) are set up with taking environmental information and usage history information into consideration.

That is, as shown in FIG. 9, the basic configuration of the electrostatic charging apparatus 22 is almost similar to that of Exemplary Embodiment 1. However, setup processing for the electrostatic charging biases Vc performed by the control unit 100 is different from that of Exemplary Embodiment 1.

In this figure, the control unit 100 includes: a Vdc control section 111 for controlling the DC component Vdc of the electrostatic charging biases Vc; a Vpp control section 112 for controlling the AC components Vpp (Vpp1, Vpp2) of the electrostatic charging biases Vc; and a reference table 113 used when the AC components Vpp (Vpp1, Vpp2) of the electrostatic charging biases Vc are to be determined.

Then, the control unit 100 acquires: environmental information (at least one of the temperature and the humidity) from an environment sensor 101; usage history information (the ON-operating time serving as the usage history of the electrostatic charging apparatus 22, the number of image-formed sheets converted into the reference size of the image forming apparatus, and the like) from a usage history memory 102; and input operation information from the operation panel 110.

Here, the DC component Vdc of the electrostatic charging biases Vc is set into a predetermined default value corresponding to a predetermined electrostatic charging level, for example, in accordance with input operation through the operation panel 110 at the time of initial setting.

Next, an example of the reference table 113 employed in the present exemplary embodiment is described below with reference to FIGS. 10A and 10B.

Appropriate values for the AC components Vpp (Vpp1, Vpp2) of the electrostatic charging biases Vc (Vc1, Vc2) depend on the environmental condition and the usage history condition of the photosensitive body 21 to a large extent. Thus, in the present exemplary embodiment, the reference table 113 is prepared in advance that is used for selecting optimal electrostatic charging biases Vc in accordance with a change in the environmental condition and the usage history condition of the photosensitive body 21.

First, the inclination change point M (see FIG. 6A) is discussed below that is selected as the AC component Vpp1 of the electrostatic charging bias Vc1. As shown in FIG. 10A, the inclination change point M varies depending on the low temperature and low humidity environment Ya (e.g., 10° C./10%), the ordinary temperature and ordinary humidity environment Yb (e.g., 22° C./50%), and the high temperature and high humidity environment Yc (e.g., 28° C./85%). Thus, the Vpp1 need be changed in accordance with the environmental condition. Further, under each environment, the inclination change point M varies also depending on the photosensitive layer film thickness (d: $d_0<d_1<d_2<d_3<d_4<d_5<d_6$). Thus, for example, when the photosensitive body 21 is degraded in association with the usage history so that the photosensitive layer film thickness d is reduced because of wear, the Vpp1 need be changed in accordance with the usage history condition.

From this point of view, as for the inclination change point M selected as Vpp1, the relation with the environmental condition and the usage history condition (e.g., the photosensitive layer film thickness d as a function of the usage history) may be measured in advance, and then on the basis of this, the reference table 113 may be prepared.

Further, the lower limit (the uniform electrostatic charging region lower limit point) of the usage range where uniform electric discharge is achieved is discussed below that is selected as the AC component Vpp2 of the electrostatic charging bias Vc2. As shown in FIG. 10B, the uniform electrostatic charging region lower limit point also depends on the environmental condition (Ya, Yb, Yc) and the usage history condition (e.g., the photosensitive layer film thickness d in association with the usage history). Thus, as for the uniform electrostatic charging region lower limit point selected as Vpp2, the relation with the environmental condition and the usage history condition (e.g., the photosensitive layer film thickness d as a function of the usage history) may be measured in advance, and then on the basis of this, the reference table 113 may be prepared.

Figure 10A:
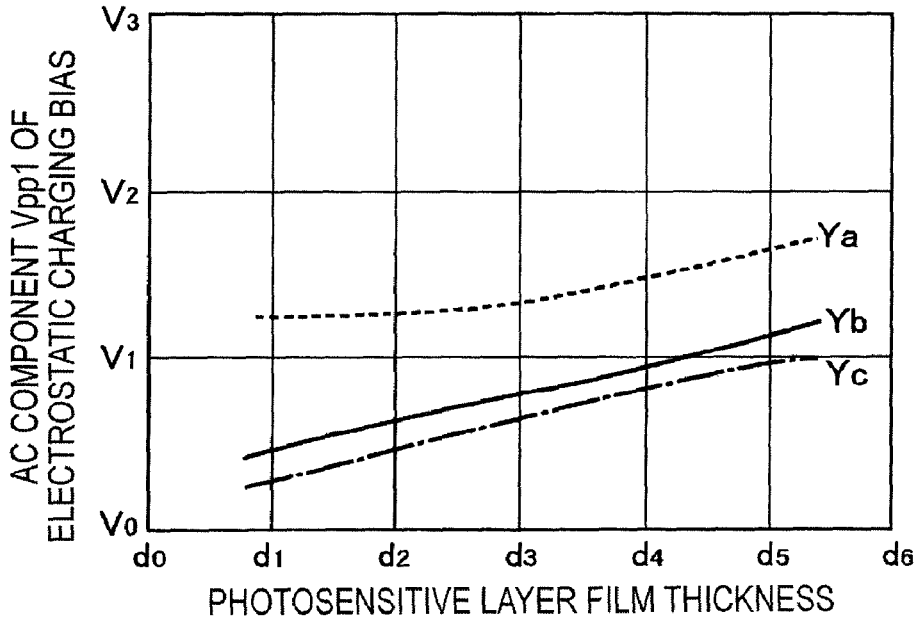
FIG. 10A is an explanation diagram showing an exemplary example of relation between an AC component Vpp1 of an electrostatic charging bias and a surface potential of a photosensitive body according to Exemplary Embodiment 2 and FIG. 10B is an explanation diagram showing an exemplary example of relation between an AC component Vpp2 of an electrostatic charging bias and a surface potential of a photosensitive body according to Exemplary Embodiment 2.
Figure 10B:
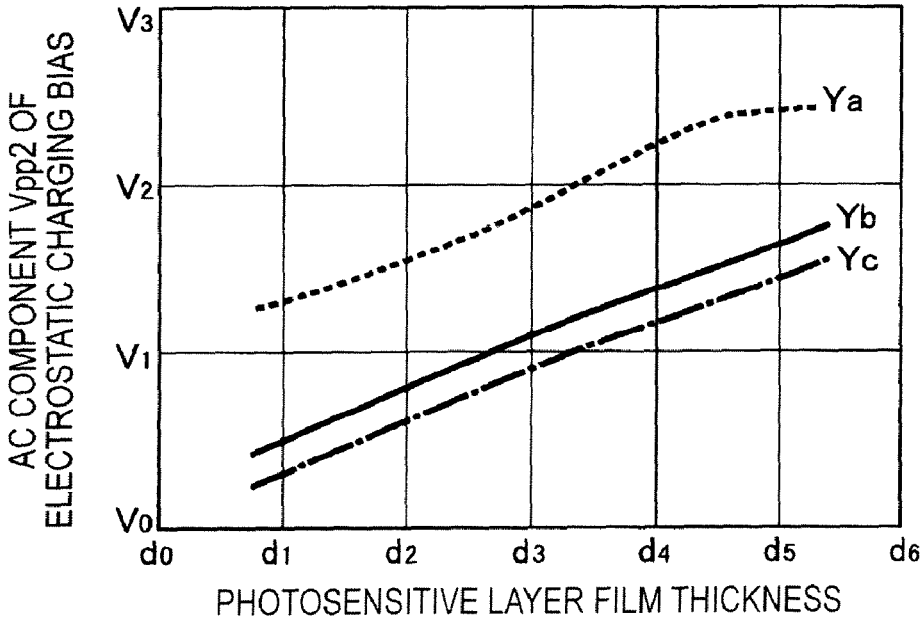

Here, in FIGS. 10A and 10B, symbols $V_0$ to $V_3$ on the vertical axis indicate scale values ($V_0<V_1<V_2<V_3$) for the AC component.

Further, in FIGS. 10A and 10B, in general, a non-uniform discharge region is present between the inclination change point M selected as Vpp1 and the uniform electrostatic charging region lower limit points selected as Vpp2. Thus, although the relation Vpp2>Vpp1 is satisfied in many cases, a tendency is present that the difference between Vpp1 and Vpp2 increases when the photosensitive layer film thickness d increases and vice versa.

Next, electrostatic charging bias setup processing in the control unit 100 is described below.

Figure 11:
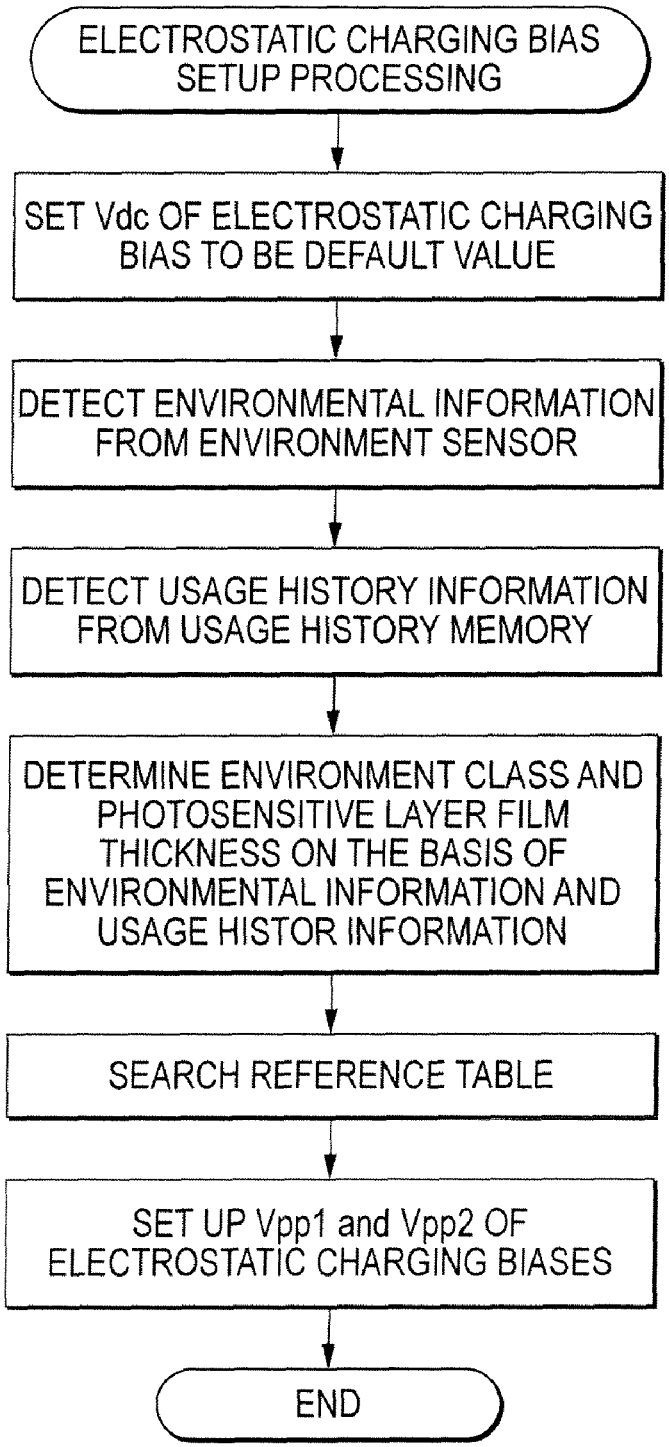
FIG. 11 is a flow chart showing the contents of electrostatic charging bias setup processing performed by an electrostatic charging bias setting control system shown in FIG. 9.

FIG. 11 is a flow chart showing electrostatic charging bias setup processing.

As shown in this figure, first, the Vdc control section 111 of the control unit 100 sets the DC component Vdc of the electrostatic charging biases Vc to be a default value defined in advance.

Then, the Vpp control section 112 of the control unit 100 detects the environmental information from the environment sensor 101 and the usage history information from the usage history memory 102 (the ON-operating time serving as the usage history of the electrostatic charging apparatus 22, the number of image-formed sheets converted into the reference size of the image forming apparatus, and the like) so as to determine the environment class (the low temperature and low humidity environment Ya, the ordinary temperature and ordinary humidity environment Yb, or the high temperature and high humidity environment Yc) on the basis of the environmental information. Further, on the basis of the usage history information, the Vpp control section 112 estimates the degree of degradation relative to the initial photosensitive layer of the photosensitive body 21 so as to determine the photosensitive layer film thickness d.

In this state, the Vpp control section 112 of the control unit 100 searches the reference table 113 shown in FIG. 9 so as to set up the Vpp1 and the Vpp2 of the electrostatic charging biases Vc on the basis of the determined environment class and the photosensitive layer film thickness d.

As described above, in the present exemplary embodiment, even when the environmental condition and the usage history condition vary, the AC components Vpp (Vpp1, Vpp2) of the electrostatic charging biases Vc are set up with taking these conditions into consideration. This provides an advantage over Exemplary Embodiment 1 in the point that a satisfactory electrostatic charging performance is maintained in accordance with the environmental condition and the usage history condition.

Further, in the present exemplary embodiment, the AC components Vpp (Vpp1, Vpp2) of the electrostatic charging biases Vc are variably set up in accordance with the environmental condition and the usage history condition. However, the AC components Vpp of the electrostatic charging biases Vc may be variably set up on the basis of any one of the environmental condition and the usage history condition. Alternatively, in a mode that the photosensitive layer film thickness d is thick, the AC components Vpp of the electrostatic charging biases Vc may be variably set up with taking into consideration both the environmental condition and the usage history condition, while in a mode that the photosensitive layer film thickness d is thin, the AC components Vpp of the electrostatic charging biases Vc may be variably set up with taking into consideration the environmental condition only. This is because the usage history condition dependence is small in the latter mode.

In the present exemplary embodiment, the reference table 113 is prepared in advance, and then with searching this table, the AC components Vpp of the electrostatic charging biases Vc are variably set up. However, the present invention is not restricted to this approach. For example, the amount of discharged electric charge may be measured in the photosensitive layer so that the photosensitive layer film thickness d may be detected. Then, on the basis of this detected information, the AC components Vpp of the electrostatic charging biases Vc may be variably set up.

Modified Exemplary Embodiment of Power Supply Unit

Figure 12:
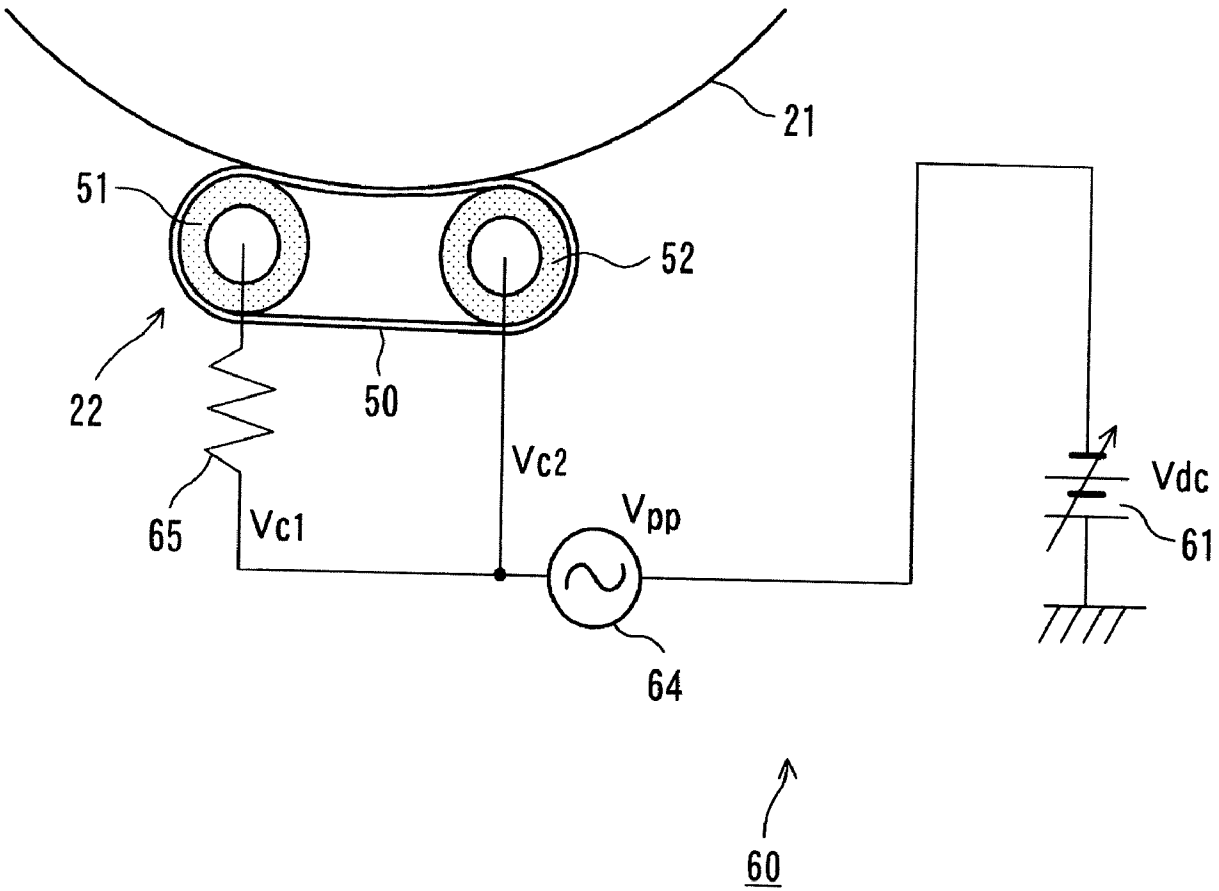
FIG. 12 is an explanation diagram showing another modified exemplary embodiment of a power supply unit of an electrostatic charging apparatus according to Exemplary Embodiments 1 and 2.

In Exemplary Embodiments 1 and 2, the mode shown in FIG. 4 or 9 has been adopted for the power supply unit 60 of the electrostatic charging apparatus 22. However, the present invention is not restricted to these. For example, as shown in FIG. 12, the power supply unit may include: a DC power supply 61 for supplying a DC component Vdc of an electrostatic charging bias Vc; an AC power supply 64 that is connected in series between the DC power supply 61 and each of the bias application rolls 51 and 52 and supplies an AC component Vpp of the electrostatic charging bias Vc; and a resistor element 65 that is inserted between the AC power supply 64 and the bias application roll 51 on the pre-nip side and reduces the AC component Vpp from the AC power supply 64.

Figure 13:
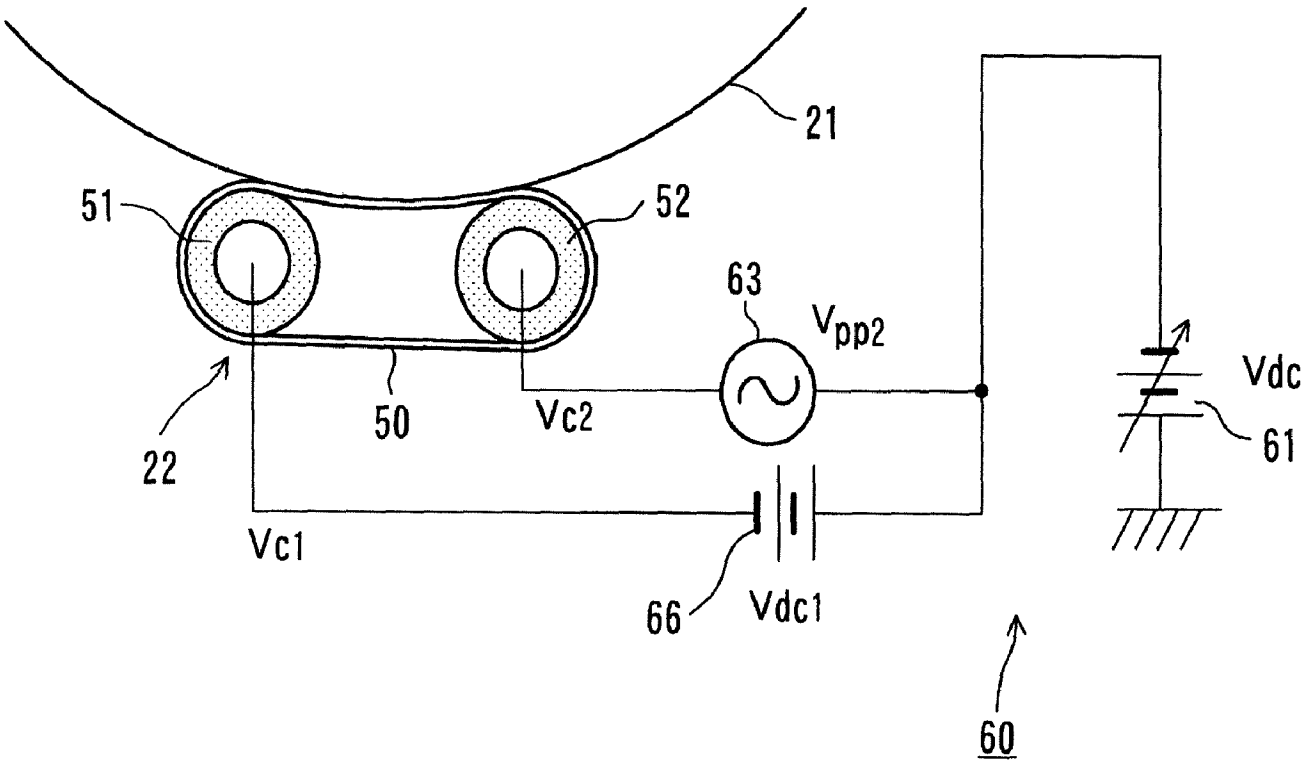
FIG. 13 is an explanation diagram showing yet another modified exemplary embodiment of a power supply unit of an electrostatic charging apparatus according to Exemplary Embodiments 1 and 2.

Further, as shown in FIG. 13, another modified exemplary embodiment of the power supply unit 60 of the electrostatic charging apparatus 22 includes: a DC power supply 61 for supplying a DC component Vdc of an electrostatic charging bias Vc; an AC power supply 63 that is connected in series between the DC power supply 61 and the bias application roll 52 on the post-nip side and supplies an AC component Vpp2 of the electrostatic charging bias Vc; and an auxiliary DC power supply 66 that is connected in series between the DC power supply 61 and the bias application roll 51 on the pre-nip side and supplies an auxiliary DC component Vdc1. In this mode, no AC component is supplied to the bias application roll 51 on the pre-nip side.

Modified Exemplary Embodiment of the Electrostatic Charging Apparatus

Figure 14A:
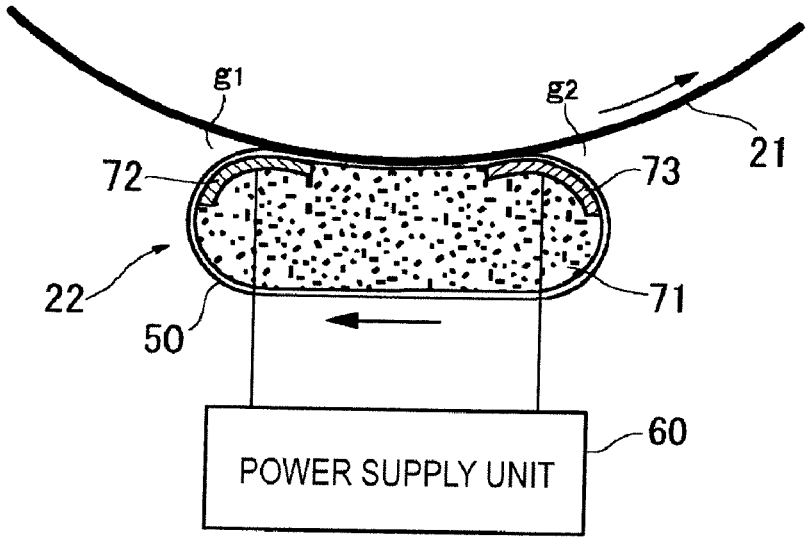
FIGS. 14A and 14B are explanation diagrams each showing yet another modified exemplary embodiment of an electrostatic charging apparatus according to Exemplary Embodiments 1 and 2.

In Exemplary Embodiments 1 and 2, a pair of bias application rolls 51 and 52 have been provided inside the electrostatic charging belt 50. However, the present invention is not restricted to this configuration. For example, as shown in FIG. 14A, for example, a pressurizing member 71 composed of an elastic material may be provided inside the electrostatic charging belt 50. Then, electrode members 72 and 73 may be provided on both sides of the pressurizing member 71 facing the photosensitive body 21 side, while electrostatic charging biases Vc1 and Vc2 may be applied on the electrode members 72 and 73 from the power supply unit 60.

Here, in this example, in order that a pre-nip gap g1 and a post-nip gap g2 that permit electric discharge should be formed between the electrode members 72 and 73 and the photosensitive body 21, the shape of the electrode members 72 and 73 need have a curved shape, or alternatively the electrostatic charging belt 50 with pressurizing member 71 and the photosensitive body 21 need pinch elastically the electrostatic charging belt 50 in such a manner that a contact zone is formed between the photosensitive body 21 and the electrode members 72 and 73.

Figure 14B:
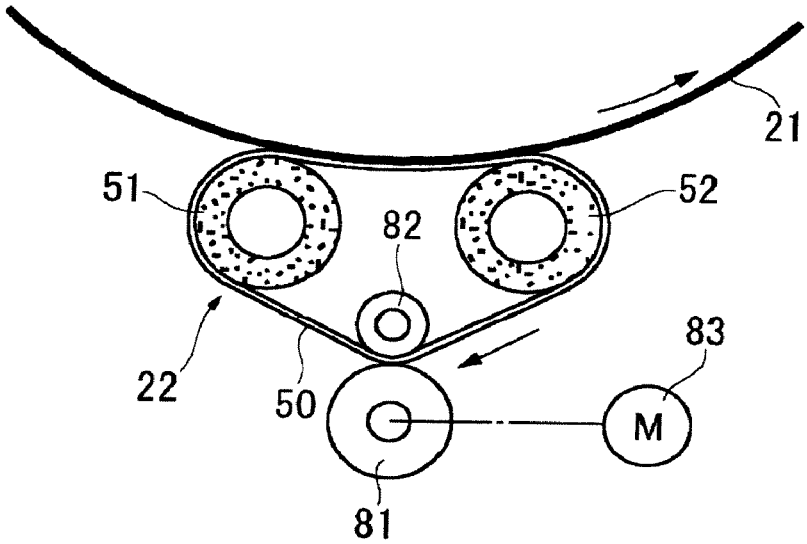

Further, in Exemplary Embodiments 1 and 2, the electrostatic charging belt 50 has rotated by following the rotation of the photosensitive body 21. However, the present invention is not restricted to this configuration. For example, as shown in FIG. 14B, a drive roll 81 may be provided outside the electrostatic charging belt 50, while a drive assist roll 82 that pinches the electrostatic charging belt 50 against the electrostatic charging belt 50 may be provided opposite to the drive roll 81. Then, the drive roll 81 may be driven by a drive motor 83 so that the electrostatic charging belt 50 may be driven with an external driving force.

EXAMPLES

Example 1

Example 1 was constructed by employing the image forming apparatus according to Exemplary Embodiment 1.

—Conditions of Image Forming Apparatus—

In the image forming apparatus according to Example 1, the process speed of the photosensitive body was 220 mm/sec, the electrostatic charging potential of the surface of the photosensitive body was −700V, and the exposure section potential of the exposure unit was −300V. Further, a developing bias voltage generated by superposing onto a DC component of −560V a rectangular wave having an amplitude (peak-to-peak voltage) of 1.0 kV, a frequency of 6 kHz, and a duty of 60% was applied on the developing roll of the developing unit, so that a toner image was formed. This toner image was transferred onto the intermediate transfer belt, then transferred onto a recording material, and then fixed by the fixing unit.

Here, the employed toner was generates by emulsion polymerization method and had a volume average particle diameter of 5.8 μm measured by a Coulter counter (fabricated by Coulter Incorporation). The toner particle diameter is not necessarily limited to this value, and may be 3 to 7 μm. The shape of the toner particle was expressed by a shape coefficient, and was calculated according to the following formula when image analysis using an image analyzer Luzex 3 (fabricated by NIRECO Corporation) was performed on an enlarged photograph of the toner particles obtained by an optical microscope (Micro Photo-FXA; fabricated by NIKON Corporation).

$$\text{Shape coefficient}=(\text{Absolutely maximum length of toner diameter})^2/\text{Toner projection area}\times(\pi/4)\times 100$$

This toner shape coefficient is expressed by the ratio between the projected area of the toner particle and the area of its circumscribed circle. In the case of a complete sphere, the coefficient has a value of 100. This value increases when the shape is deformed. The shape coefficient is calculated for plural toner particles, and their average is adopted as a representative value. In this example, toner having a shape coefficient of 130 to 140 was employed. Into the toner, inorganic particulates (an external additive) such as silica and titania having an average particle diameter of 10 to 150 nm were externally added in an appropriate amount. Here, in this example, the above-mentioned developing agent was employed. However, the present invention is not necessarily limited to this. That is, a pulverization toner used conventionally may be employed. Further, a carrier composed of ferrite beads having an average particle diameter of 35 μm was employed.

—Electrostatic Charging Apparatus—

Electrostatic charging belt: An electric conduction agent was dispersed into PVdF (contact angle θ for water: approximately 90 degrees) so that the surface electrical resistance was adjusted into $10^6\Omega/\square$, and then the material was formed into the shape of a thin film having a thickness of 45 μm. This film was employed.

Bias application roll: This was an electrically conductive foaming polyester material having an outer diameter of ϕ12 through which a shaft core member composed of an electrically conductive metal penetrates.

Pressing mechanism: The press spring pressed one end of the bias application roll with a force of 275 gf apart from the weights of the bias application rolls.

Figure 15:
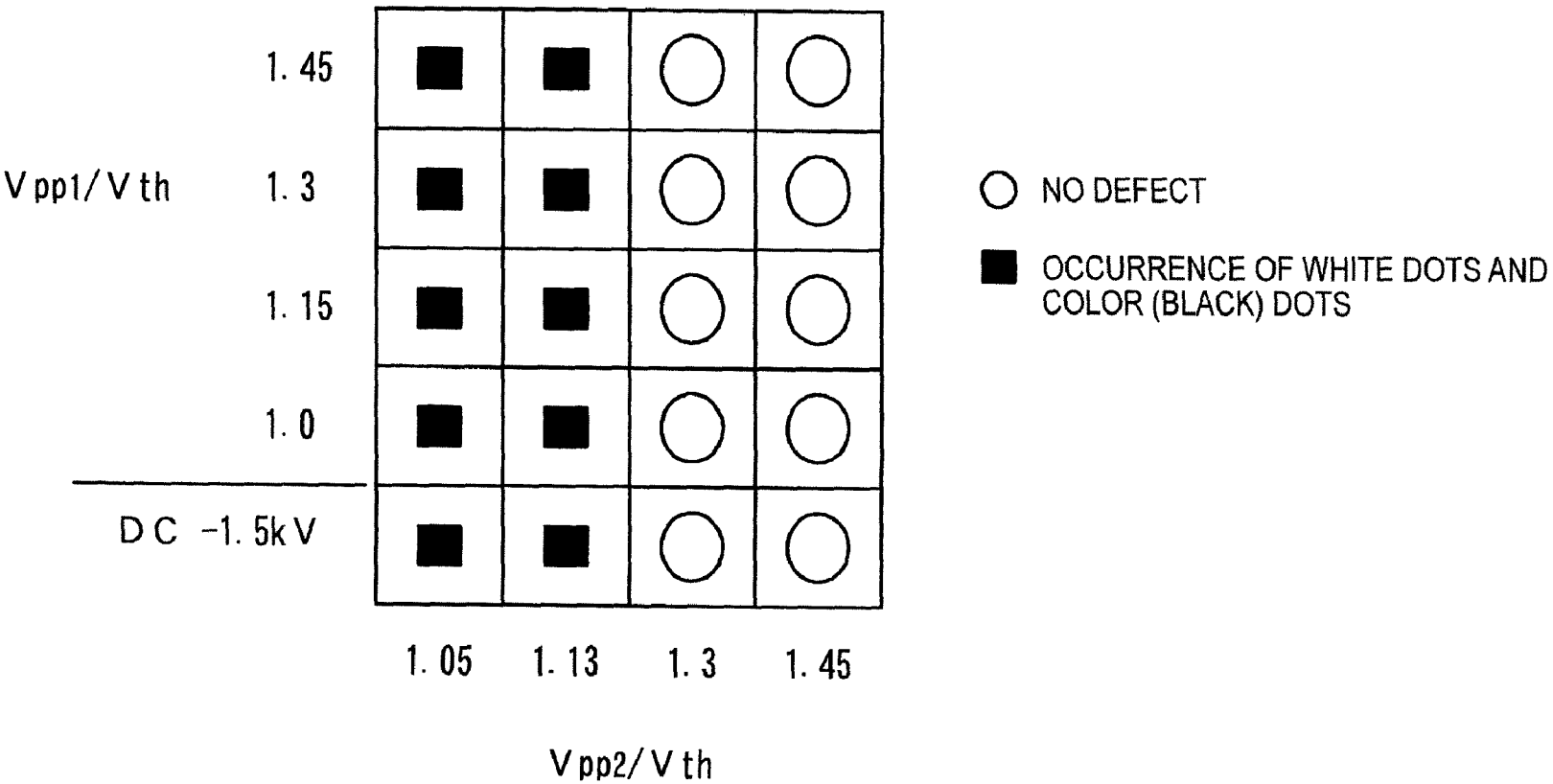
FIG. 15 is an explanation diagram showing a result of investigation of the situation of occurrence of image defects for various Vpp1/Vth and Vpp2/Vth values in an electrostatic charging apparatus according to Example 1.

In this example, the situation of occurrence of image defects (defects) was investigated with changing the value of Vpp1-Vpp2, so that the result shown in FIG. 15 was obtained.

In this figure, symbol Vth indicates a point (corresponding to the inclination change point M) where the inclination of Vpp-Vh (the surface potential of the photosensitive body) varies. Its value is 1.42 kVpp.

As seen from this figure, when electric discharge was performed with a sufficient Vpp2, defects did not occur. Further, also in a mode that a DC power supply in replace of an AC power supply was connected to the bias application roll on the pre-nip side (the mode shown in FIG. 13/DC component (DC)=−1.5 kV), a similar result was obtained.

Figure 16:
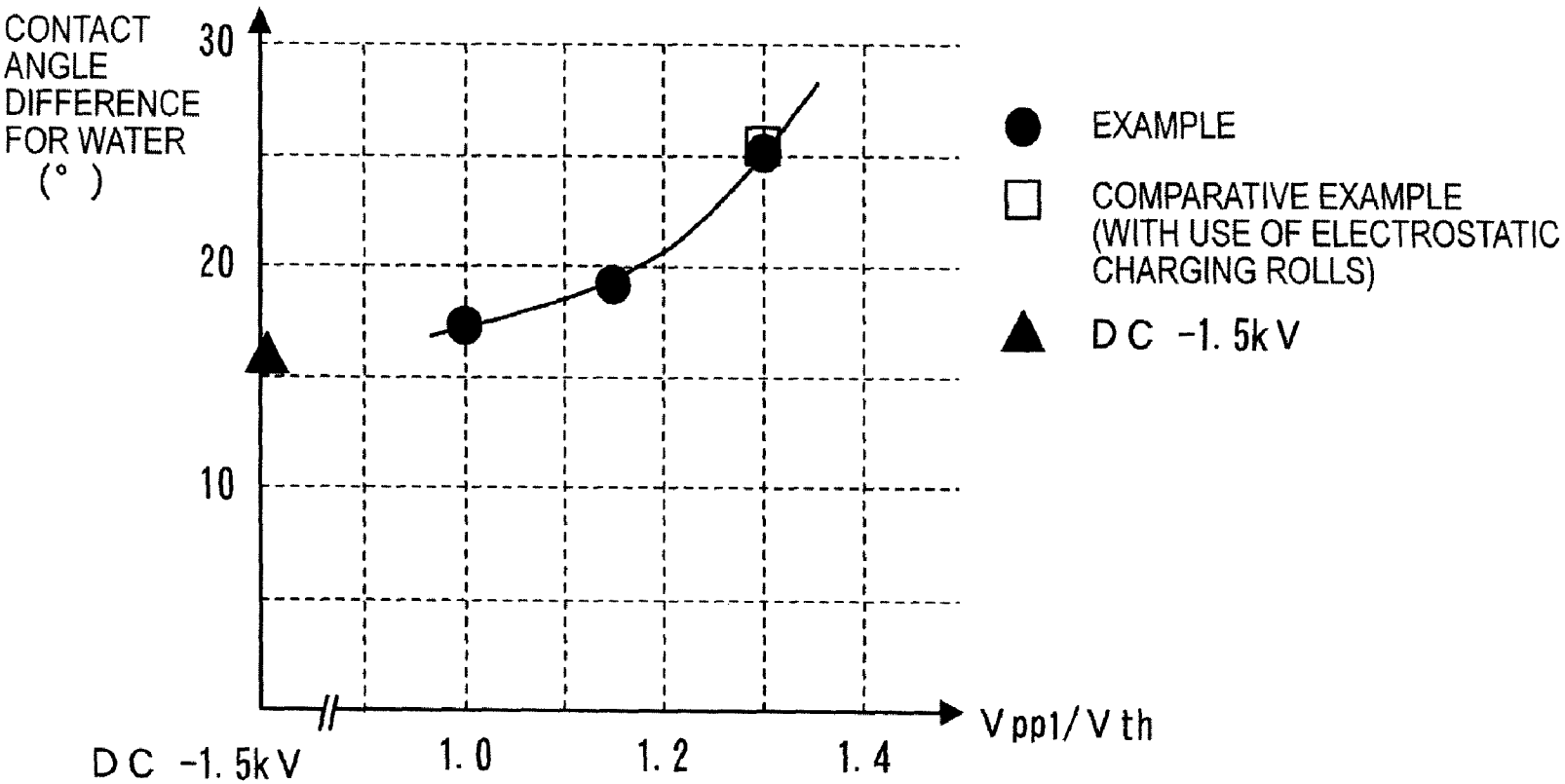
FIG. 16 is an explanation diagram showing a result of measurement of a contact angle change for water on a surface of a photosensitive body in a case that electric discharge is performed with a fixed Vpp2/Vth value of 1.3 and various Vpp1/Vth values according to Example 1.

Next, a contact angle change for water after electric discharge was investigated for a fixed Vpp2/Vth value of 1.3 and various Vpp1/Vth values. The obtained result is shown in FIG. 16.

At that time, the influence of the electrostatic charging was investigated in a state that the cleaning unit, the developing unit, the intermediate transfer belt, and the primary transfer unit were removed. The contact angle was measured before the start of electric discharge and after 30 revolutions of the photosensitive body after that. Then, it was assumed that the difference was related to the amount of deposit of discharge product. Here, the AC frequency of electrostatic charging bias was 1440 Hz.

This result indicates that when the Vpp1 is reduced, the amount of deposit of discharge product can be suppressed.

Here, symbol □ in the figure indicates the data of a comparison example where one electrostatic charging roll is employed, and shows the contact angle difference for water in the case of Vpp1/Vth=1.3 (Vth=1.85 kVpp). Further, symbol Δ indicates the data of a mode that a DC component (DC)=−1.5 kV is applied on the bias application roll on the pre-nip side.

Similarly, a running test was performed on the image forming apparatus so that the difference in the wear rate of the photosensitive body was investigated.

Also at this time, the value Vpp2/Vth was fixed to 1.3. The running conditions were as follows.

Electrostatic charging biases: Vdc=−720V, Vpp1/Vth=1.0, 1.15, 1.3, Vpp2/Vth=1.3

Frequency: 1440 Hz

Process speed: 220 mm/sec

Number of print sheets per job: 100 sheets, Total number of print sheets: 30,000 sheets Ratio of image area: 5%

Operating environment: 22° C./50%

Figure 17:
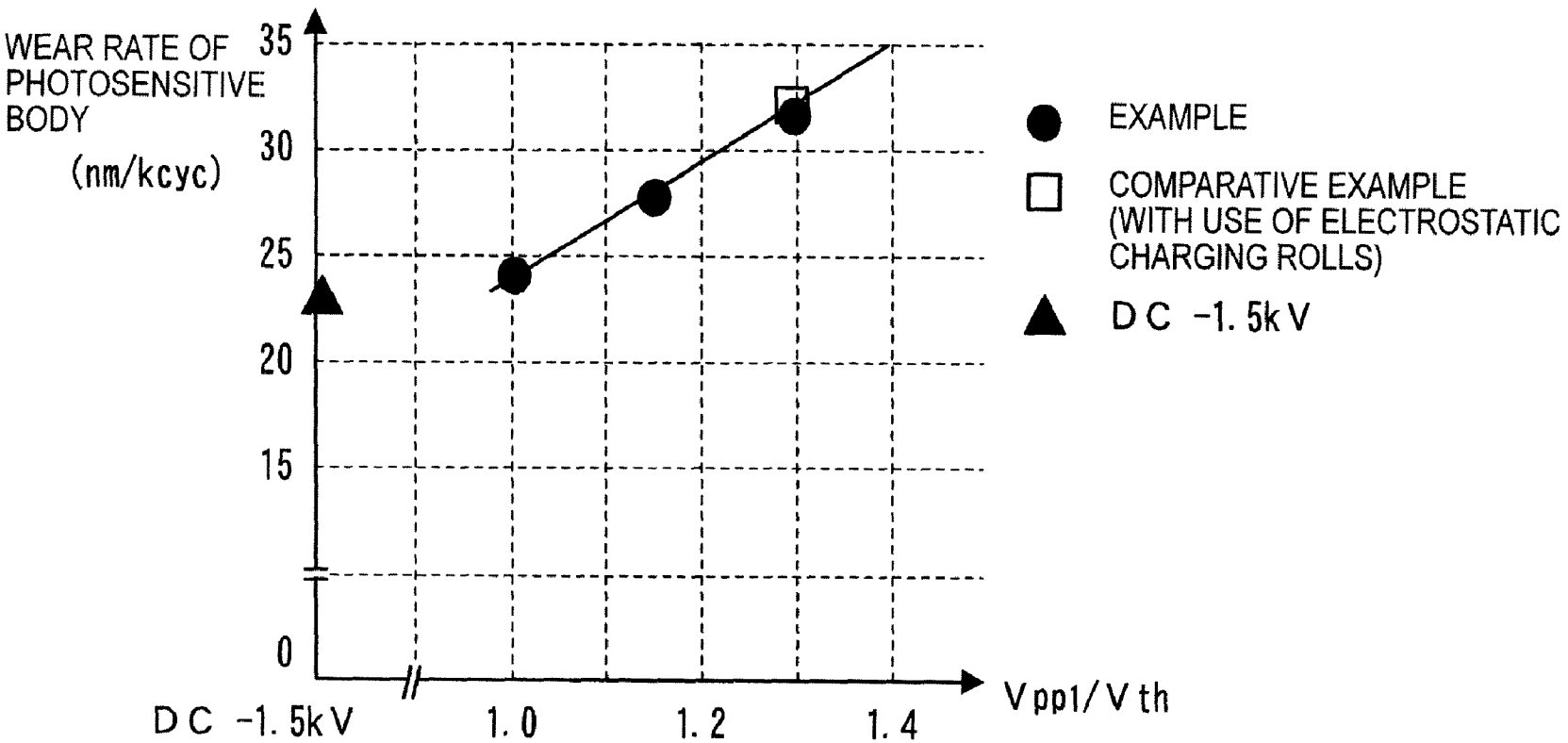
FIG. 17 is an explanation diagram showing a result of measurement of a wear rate change on a surface of a photosensitive body in a case that electric discharge is performed with a fixed Vpp2/Vth value of 1.3 and various Vpp1/Vth values according to Example 1.

The photosensitive body wear rate at this time is shown in FIG. 17.

Also from the perspective of wear, when the Vpp1 is reduced, the amount of deposit of discharge product can be suppressed.

Example 2

Figure 18:
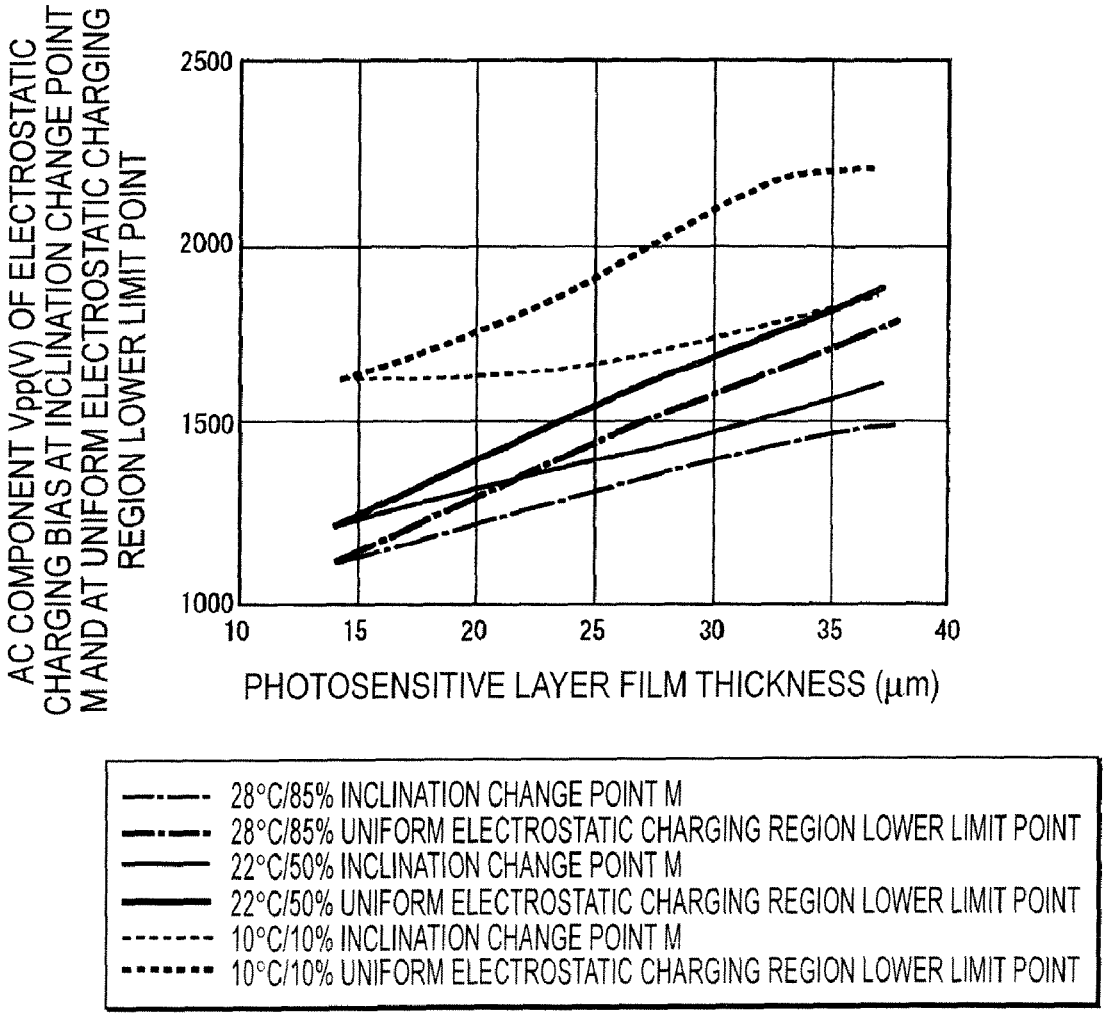
FIG. 18 is an explanation diagram showing an exemplary example of a reference table employed in an electrostatic charging apparatus according to Example 2.

This example was an implementation of the image forming apparatus according to Exemplary Embodiment 2. FIG. 18 shows a particular example of the reference table used for determining the Vpp1 and the Vpp2 of the electrostatic charging apparatus.

The electrostatic charging apparatus of this example variably sets up the Vpp1 and the Vpp2 of the electrostatic charging apparatus in accordance with the environmental condition and the usage history condition on the basis of the reference table shown in FIG. 18.

The reference table shown in FIG. 18 is described below.

First, the photosensitive body employed in this example was as follows.

In this photosensitive body, a photosensitive layer was stacked on a drum base such as aluminum. The photosensitive layer had a charge transport layer in the top and a charge generating layer. Then, an under coating layer for leakage prevention was formed in the bottom.

Examples of the individual layers are described below.

Under Coating Layer:

100 weight parts of zinc oxide (SMZ-017N: fabricated by TAYCA Corporation) and 500 weight parts of toluene were agitated and mixed with each other. Then, 2 weight parts of silane coupling agent (A1100: fabricated by Nippon Unicar Co., Ltd.) was added, and then they were agitated for 5 hours. After that, toluene was vacuum-distilled. Then, baking was performed at 120° C. for 2 hours. As a result of fluorescent X-ray analysis of the obtained surface treatment zinc oxide, the Si element intensity was $1.8\times10^{-4}$ of the zinc element intensity. 35 weight parts of the surface treatment zinc oxide, 15 weight parts of block-type polyisocyanate Sumidur 3175 (fabricated by Sumitomo-Bayern Urethane Co., Ltd.) serving as a curing agent, 6 weight parts of butyral resin BM-1 (fabricated by Sekisui Chemical Co., Ltd.), and 44 weight parts of 2-butanone were mixed with each other, and then dispersion processing was performed for 2 hours by a sand mill using glass beads of 1 mmϕ, so that a dispersion liquid was obtained. Then, 0.005 weight part of dioctyltin dilaurate serving as a catalyst and 17 weight parts of Tospearl 130 (fabricated by GE Toshiba Silicones Co., Ltd.) were added into the obtained dispersion liquid, so that an under coating layer coating liquid was obtained. This coating liquid was applied onto a drum base composed of an aluminum material of 30 mmϕ by a dip painting method. Then, dry hardening was performed at 160° C. for 100 minutes, so that an under coating layer having a thickness of 20 μm was obtained.

Charge Generating Layer:

The employed charge generating material was gallium chloride phthalocyanine. 15 weight parts of this, 10 weight parts of vinyl chloride-vinyl acetate copolymer resin (VMCH, fabricated by Union Carbide Japan Co., Ltd.), and 300 weight parts of n-butyl alcohol were mixed with each other. Then, dispersion processing was performed on this mixture for 4 hours by a sand mill. Then, the obtained dispersion liquid was applied onto the under coating layer by dip painting, and then dried so that a charge generating layer having a film thickness of 0.2 μm or the like was obtained.

Charge Transport Layer:

8 weight parts of polytetrafluoroethylene resin particles and 0.16 weight part of fluorine family graft polymer serving as a dispersion assisting agent were sufficiently agitated and mixed into 49 weight parts of tetrahydrofurane and 21 weight parts of toluene, so that a polytetrafluoroethylene resin particle suspension was prepared.

Then, 40 weight parts of N,N'-bis(3-methylphenyl)-N,N-diphenylbenzidine and 60 weight parts of bisphenol Z polycarbonate resin (molecular weight: 40,000) were sufficiently dissolved and mixed into 231 weight parts of tetrahydrofurane and 99 weight parts of toluene. After that, the above-mentioned polytetrafluoroethylene resin particle suspension was added to this, and then agitated and mixed with each other. Then, by using a high pressure homogenizer (fabricated by Nanomizer Co., Ltd., trade name: LA-33S) provided with a penetration type chamber having fine passages, dispersion processing using a pressure up to 500 kgf/cm$^2$ was repeated four times so that a polytetrafluoroethylene resin particle dispersion liquid was prepared. Then, the obtained coating liquid was applied onto the charge generating layer by dip painting, and then dried so that a charge transport layer having a film thickness of 29 μm or the like was formed.

Further, in FIG. 18, the classes of environmental condition are as follows.

Low temperature and low humidity environment Ya: 10° C./10%

Ordinary temperature and ordinary humidity environment Yb: 22° C./50%

High temperature and high humidity environment Yc: 28° C./85%

Further, in FIG. 18, the photosensitive layer film thickness on the horizontal axis indicates the film thickness of the charge transport layer. This corresponds to the degree of degradation (mainly, wear) in association with the usage history of the photosensitive body. Here, it is recognized that the inclination change point M and the uniform electrostatic charging region lower limit point are hardly affected by the layer thicknesses of the under coating layer and the charge generating layer.

Further, in this example, the AC component of the electrostatic charging bias corresponding to the inclination change point M was selected as Vpp1, while the AC component of the electrostatic charging bias at the uniform electrostatic charging region lower limit point was selected as Vpp2. In FIG. 18, the vertical axis indicates the AC component (Vpp1) of the electrostatic charging bias corresponding to the inclination change point M for the photosensitive layer film thickness and the AC component (Vpp2) of the electrostatic charging bias at the uniform electrostatic charging region lower limit point, under individual environmental conditions.

As seen from FIG. 18, each of the AC component (Vpp1) of the electrostatic charging bias corresponds to the inclination change point M and the AC component (Vpp2) of the electrostatic charging bias at the uniform electrostatic charging region lower limit point increases in association with a change from the low temperature and low humidity environment to the high temperature and high humidity environment. Further, each of the AC components tends to increase with increasing photosensitive layer film thickness under each environment, and vice versa.

Further, the difference between Vpp1 and Vpp2 tends to decrease (into approximately 0 equal to or below 15 μm) with decreasing photosensitive layer film thickness under each environment, and vice versa.

Thus, in this example, the environmental condition and the usage history condition may be determined on the basis of the environmental information and the usage history information, and then the reference table shown in FIG. 18 may be searched so that the Vpp1 and the Vpp2 may be determined.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An electrostatic charging apparatus, comprising:

an endless-shaped electrostatic charging belt having electrical conductivity, the electrostatic charging belt being arranged in a state of having a predetermined contact zone being in contact with a moving to-be-charged body and moving in the same direction as a moving direction of the to-be-charged body;

a plurality of electrode members including at least a first electrode member and a second electrode member, the plurality of electrode members being provided inside the electrostatic charging belt, and the first and second electrode members being provided on both sides of the contact zone of the electrostatic charging belt in the moving direction thereof so as to press the electrostatic charging belt against the to-be-charged body and forming gaps that permit electric discharge between the to-be-charged body and an outer surface of the electrostatic charging belt, the gaps being adjacent to the respective sides of the contact zone of the electrostatic charging belt; and a bias application unit that applies mutually different electrostatic charging biases to the respective plurality of electrode members such that an AC component of a first electrostatic charging bias applied on the first electrode member is smaller than an AC component of a second electrostatic charging bias applied on the second electrode member, the second electrode member being located downstream of the first electrode member in the moving direction of the to-be-charged body, and wherein the bias application unit supplies the AC components to both of the first electrode member and the second electrode respectively.

2. The electrostatic charging apparatus according to claim 1, wherein the bias application unit applies the first electrostatic charging bias to the first electrode member, an AC component of the first electrostatic charging bias being equal to or below an inclination change point of a surface potential of the to-be-charged body for the AC component.

3. The electrostatic charging apparatus according to claim 1, wherein the bias application unit applies the second electrostatic charging bias to the second electrode member, an AC component of the second electrostatic charging bias exceeding an inclination change point of a surface potential of the to-be-charged body for the AC component and falling within a range where uniform electric discharge can be performed between the second electrode member and the to-be-charged body.

4. The electrostatic charging apparatus according to claim 1, wherein the first and second electrode members are rotatable roll-shaped members about which the electrostatic charging belt is entrained.

5. The electrostatic charging apparatus according to claim 1, wherein the bias application unit has an operating environment determination section that determines an operating environment and changes the electrostatic charging biases applied to the individual electrode members on the basis of a determination result from the operating environment determination section.

6. The electrostatic charging apparatus according to claim 1, further comprising:

a press member that presses the plurality of electrode members toward the to-be-charged body so as to form the contact zone and the gaps comprising a pre-nip gap and a post-nip gap adjacent to the respective sides of the contact zone in the moving direction of the to-be-charged body, wherein the press member presses the plurality of electrode members so that the post-nip gap does not substantially fluctuate.

7. An image forming assembly, comprising:

a photosensitive body serving as a to-be-charged body; and an electrostatic charging apparatus according to claim 1 located to face the photosensitive body, wherein the image forming assembly is detachably attached to an image forming apparatus body.

8. An image forming apparatus, comprising:

a photosensitive body serving as a to-be-charged body; and an electrostatic charging apparatus according to claim 1 located to face the photosensitive body.

9. An electrostatic charging apparatus, comprising:

an endless-shaped electrostatic charging belt being arranged in a state of having a predetermined contact zone being in contact with a moving to-be-charged body and moving in the same direction as a moving direction of the to-be-charged body; and a plurality of electrode members including at least a first electrode member and a second electrode member, the plurality of electrode members being provided inside the electrostatic charging belt, the first and second electrode members being provided on both end sides of the contact zone of the electrostatic charging belt in the moving direction thereof so as to press the electrostatic charging belt against the to-be-charged body and forming gaps that permit electric discharge between the to-be-charged body and an outer surface of the electrostatic charging belt, the gaps being adjacent to the both end sides; and a bias application unit that applies mutually different electrostatic charging biases to the respective plurality of electrode members such that an AC component of a first electrostatic charging bias applied on the first electrode member is smaller than an AC component of a second electrostatic charging bias applied on the second electrode member, the second electrode member being located downstream of the first electrode member in the moving direction of the to-be-charged body, wherein the bias application unit supplies the AC components to both of the first electrode member and the second electrode respectively.

* * * * *